US005931004A

United States Patent [19]

Yoo et al.

[11] Patent Number: 5,931,004

[45] Date of Patent: Aug. 3, 1999

[54] REFRIGERATOR AND CONTROL METHOD THEREFOR

[75] Inventors: Han Joo Yoo, Kwangmyong; Jae Seung Lee, Suwon; Kook Jung Suh; Hai Min Lee, both of Seoul; Jae Hoon Lim, Suwon, all of Rep. of Korea

[73] Assignee: Samsung Electronics Co., Ltd., Suwon, Rep. of Korea

[21] Appl. No.: 08/737,529

[22] PCT Filed: Nov. 11, 1995

[86] PCT No.: PCT/KR95/00147

§ 371 Date: Jan. 7, 1997

§ 102(e) Date: Jan. 7, 1997

[87] PCT Pub. No.: WO96/15413

PCT Pub. Date: May 23, 1996

[30] Foreign Application Priority Data

| | | | |
|---|---|---|---|
| Nov. 11, 1994 | [KR] | Rep. of Korea | 94-29478 |
| Nov. 17, 1994 | [KR] | Rep. of Korea | 94-30322 |
| Nov. 17, 1994 | [KR] | Rep. of Korea | 94-30323 |
| Nov. 22, 1994 | [KR] | Rep. of Korea | 94-30782 |
| Nov. 22, 1994 | [KR] | Rep. of Korea | 94-30802 |
| May 18, 1995 | [KR] | Rep. of Korea | 95-12395 |

[51] Int. Cl.[6] ..... F25D 21/12; F25D 17/00

[52] U.S. Cl. ..... 62/82; 62/179; 62/180

[58] Field of Search ..... 62/179, 82, 180, 62/526

[56] References Cited

U.S. PATENT DOCUMENTS

| | | | |
|---|---|---|---|
| 2,780,441 | 2/1957 | Rhodes | 62/526 X |
| 4,416,119 | 11/1983 | Wilson et al. | 62/180 X |
| 4,495,780 | 1/1985 | Kaneko et al. | 236/91 A |
| 5,428,965 | 7/1995 | Grunwald et al. | 62/180 |

FOREIGN PATENT DOCUMENTS

| | | | |
|---|---|---|---|
| 404194569 | 7/1992 | Japan | 62/179 |

*Primary Examiner*—William Wayner

*Attorney, Agent, or Firm*—Burns, Doane, Swecker & Mathis, L.L.P.

[57] ABSTRACT

A refrigerator having freezing and refrigerating compartments and a refrigerating H.M. cycle and a control method therefor, comprises a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, and a control portion for controlling the operation of the compressor and the freezing and refrigerating fans, thereby performing both compartments to be maintained at the constant temperature.

97 Claims, 21 Drawing Sheets

REFRIGERATOR AND CONTROL METHOD THEREFOR

BACKGROUND OF INVENTION

The invention is related to providing a refrigerator, and in particular, to providing a refrigerator having high efficiency multi-evaporator cycle(H.M. CYCLE) and control method thereof for performing the refrigerating and freezing of the constant temperature in each of divided compartment thereof by using separate evaporators and their related fans.

In general, a refrigerator comprises a body 4 into which a freezing compartment 2 and a refrigerating compartment 3 are divided from each other by a middle partition 1 with doors 5 and 6 being provided as shown in FIG. 1. The refrigerator has a refrigerating cycle including a compressor 7, a condenser 8, a capillary tube 9 and an evaporator 10 connected in turn by means of refrigerant tubes 11 to one another forming a closed loop as shown in FIG. 2. In other words, The refrigerant performs the refrigerating cycle operation for the purpose of the energy state conversion during passing through the refrigerant tubes 11 and various components. Especially, the evaporator 10 absorbs the heat from around its circumference and generates cooled air.

Referring to FIG. 1, the compressor 7 is mounted on the lower portion of the body 4, and the evaporator 10 is mounted in the rear wall of the refrigerating compartment 2. A cooling fan 12 is provided over the upper portion of the evaporator 10. A fan guide 14 and a cooled air duct 15 each having cooled air discharging portions 13 are provided at proper places in the rear wall of the refrigerator body 4, so that a part of cooled air heat-exchanged at the evaporator 10 is supplied through the discharging portion 13 of the fan guide 14 into the freezing compartment 2, and the remainder is introduced through the discharging portion 13 of the cooled air duct 15 into the refrigerating compartment 3. And then after the cooled air is circulated in each compartment, it again returns to the evaporator 10 to be heat-exchanged through first and second feed-back passages 17 and 18 which are formed on a middle partition 1. An adjusting damper 18 is for adjusting an amount of cooled air to be supplied to the refrigerating compartment 3.

Referring to FIG. 3, the refrigerator is ordinarily controlled according to the method of the prior art as follows: the temperature $T_F$ of the freezing compartment 3(called "freezing temperature" below) is detected in order to determine whether the compressor 7 is operated or not. The freezing temperature $T_F$ is compared with the freezing set temperature $T_{FS}$ previously set by using a temperature adjuster. Therefore, control performs at step 110 to determine whether the freezing temperature $T_F$ is larger than the freezing set temperature $T_{FS}$ of the freezing compartment (called "the freezing set temperature" below). If the temperature $T_F$ is over the freezing set temperature $T_{FS}$, step 110 goes onto step 111 to turn on the compressor 7 and the cooled fan 10. If the freezing temperature $T_F$ is below the freezing set one $T_{FS}$, step 110 goes onto step 112 to turn off the compressor 7 and the cooling fan 10. After the respective operation of steps 111 and 112, control executes step 113 to determine whether the temperature $T_R$ of the refrigerating compartment 3(called "refrigerating temperature" below) is larger than the set temperature $T_{RS}$ of the refrigerating compartment(called "the refrigerating set temperature below) previously set by using a temperature adjuster according to their comparison results. If the refrigerating temperature $T_R$ is over the refrigerating set one $T_{RS}$, step 113 goes onto step 114 to open the adjusting damper 18. On the contrary, if the refrigerating temperature $T_R$ is below the refrigerating set one $T_{RS}$, step 110 goes onto step 115 to close up the adjusting damper 18.

Therefore, during the operation of the compressor 7 and the cooling fan 10, the adjusting damper 18 is operated to supply a proper amount of cooled air into the refrigerating compartment 3, but when the compressor 7 is turned off, even through the adjusting damper 18 is opened based on the fact that the refrigerating temperature $T_R$ is higher than the refrigerating set temperature $T_{RS}$, under the non-operation of the cooling fan 10 the introduction of the cooled air into the refrigerating compartment 3 does not smoothly happen. It means the temperature rise in the refrigerating compartment 3. Furthermore, the amount of of the cooled air into the refrigerating compartment 3 does not smoothly happen. It means the temperature rise in the refrigerating compartment 3. Furthermore, the amount of cooled air can be adjusted, but the temperature of the refrigerating compartment represents the greater deviation according to the operation or non-operation of the compressor 7. As a result, the constant temperature refrigerating is very difficult.

The freezing compartment and the refrigerating compartment are set to be respectively kept at 3° C. and −18° C. under the standard temperature condition. Then, it has problems in that there are no any limitation in controlling two temperature ranges using one heat-source or cooler and the energy efficiency reduction of the refrigerator. In other words, in case that one heat-exchanger controls two temperature ranges of the refrigerating and freezing compartments by the predetermined temperatures, the heat-exchanger, the refrigerating compartment and the freezing compartment each may show greater differences between their temperatures caused during operating and non-operating. It means the generation of the non-reversible loss in a thermodynamic respect, following by the reduction of the energy efficiency.

The refrigerator is configured so that the freezing and refrigerating compartments are communicated to each other through the ducts and the feed-back passages. It has problems in that the moisture emitted from foodstuffs of the refrigerating compartment makes much frost on the surfaces of the heat-exchanger having lower temperature, an amount of wind passing through the heat-exchanger is reduced, and thus the energy efficiency of the refrigerator is decreased.

The refrigerator has complex procedures of generating cooled air at the heat-exchanger, guiding it through the cooling duct, adjusting an amount of cooled air and supplying the adjusted amount of cooled air to the refrigerating compartment. It takes much time to make the refrigerating compartment maintained at the predetermined temperature 3° C. Especially, at the time of the initial starting up or re-starting of the refrigerator after the long-time's stopping, it takes much time under the high temperature condition of about 30° C. to maintain the refrigerating compartment at the standard temperature. It is not also possible to quickly respond to the temperature changes of the refrigerating compartment. That is why the constant temperature refrigerating is not realized. To it, the refrigerator is proposed to provide an exclusive fan in each of the freezing and refrigerating compartments, but only one heat-exchanger is mounted in the freezing compartment. It has not only a limitation in cooling the refrigerating compartment in a high speed but also a problem in that the respective control of the refrigerating and freezing compartments can not be performed.

The refrigerator also has a problem in that a large amount of frost is formed on the heat-exchanger, because the cooled air becomes wet air during returning to the heat-exchanger through the feed-back passage after the circulation in the refrigerating compartment. The frost does not melt away during the non-operation of the refrigerator, so that it causes the refrigerating compartment to be dried. Whereby, the stored foodstuffs can not be kept fresh in the refrigerating compartment for a long time period.

The refrigerator has a bad effect on the foodstuffs and ices stored in the freezing compartment due to the odors, etc. of foods such as a kimchi called fermentation vegetables, because the cooled air separately supplied to the refrigerating and freezing compartments are fed back to the heat-exchanger, mixed with each other and then supplied thereto.

The refrigerator requires the cooled air duct for distributing cooled air generated at the heat-exchanger to the refrigerating and freezing compartments, respectively, and a feed-back passages for guiding cooled air to be fed-back to the heat-exchanger. Thus, it causes the complex of the configuration and the loss of cooled air related thereto.

A typical prior art is U.S. Pat. No. 5,150,583 that discloses a refrigerator including a refreezing compartment provided with an evaporator and a fan and a refrigerating compartment provided with an evaporator and a fan. The refrigerator is to presuppose the use of the non-azeotrope mixture refrigerant having two components of boiling points different from each other. In case of using the non-point of a high temperature range is used for cooling the refrigerating compartment, and the refrigerant having the melting point of a low temperature range is used for cooling the freezing compartment. Therefore, it has an advantage in that two refrigerant enables the heat-exchanger to have the smaller heat transferring temperature difference to air in compartments over their own temperatures and decrease the thermal dynamic non-revisable loss, thereby improving the energy efficiency. But, it requires the wider heat transferring area of the heat-exchanger in order to accomplish the predetermined heat-transferring, which means that the heat-exchanger becomes larger. Also, a gas-liquid separator must be provided in the pipe laying, because it is not necessary to introduce refrigerant evaporated in the high temperature area into the low temperature one. The adjustment of the appropriate mixing ratio of two refrigerants is difficult. Even if the mixing of two refrigerants is exactly accomplished, the mixed state has the potential possibility to be changeable in each component of the refrigerating cycle. The mixing ratio also is changeable according to the load state of compartments or the open air temperature out of the refrigerator. Furthermore, during the mass-producing of products it is more difficult to seal two refrigerants into the pipe laying at the exact mixing ration. If a predetermined allowable error is existed in the sealed amount of refrigerant, the mixture refrigerant deteriorates its own inherent performance.

The main object of the invention is to provide a refrigerator having high efficiency multi-evaporator cycle(H.M. CYCLE: called "H.M. cycle" below) and control method thereof for performing the refrigerating and freezing of the constant temperature and the high humidity in each of independently divided compartment thereof by using separate evaporators and their related fans.

Another object of the invention is to provide a refrigerator having H.M. cycle and control method thereof for controlling the operating of a system in a different manner according to the state of open air out of the refrigerator, thereby cooling the freezing and refrigerating compartments, quickly and efficiently.

Another object of the invention is to provide a refrigerator having H.M. cycle and control method thereof, comprising independent divided freezing and refrigerating compartments, each of which is provided with an evaporator and an air circulation fan(called "fan" below) to respectively be controlled, so that the temperature difference between the compartment and its evaporator is reduced, thereby decreasing the thermal dynamic non-reversible loss according to the system control and enhancing the energy efficiency.

Another object of the invention is to provide a refrigerator having H.M. cycle and control method thereof for performing the defrosting of the evaporator, using the refrigerating air of a relatively higher temperature during the turning-off of a compressor and then circulating the melted moisture to form the high humidity environment in the refrigerating compartment, thereby enabling the fresh food storage for a long time period.

Another object of the invention is to provide a refrigerator having H.M. cycle and control method thereof, comprising independent divided freezing and refrigerating compartments provided with a cooling system(an evaporator and an air circulation fan) to control each compartment, independently, thereby improving the cooling speed of each compartment.

Another object of the invention is to provide a refrigerator having H.M. cycle and control method thereof, comprising independent divided freezing and refrigerating compartments provided with a cooling system(an evaporator and an air circulation fan) to control each compartment, independently, thereby improving the air circulating speed, as well as to detect the temperature, minutely, by means of a sensor installed in each compartment, thereby responding to the temperature rising, quickly.

Another object of the invention is to provide a refrigerator having H.M. cycle and control method thereof, comprising completely separated freezing and refrigerating compartments to prevent odors emitted from stored foodstuffs such as pickled vegetables from being circulated into each other.

Another object of the invention is to provide a refrigerator having H.M. cycle and control method thereof, comprising a cooling system provided with two evaporators and two fans, thereby simplifying the configuration of the refrigerating cycle and enables single refrigerant to be used, thereby improving the mass-production.

Another object of the invention is to provide a refrigerator having H.M. cycle and control method thereof for operating the freezing and refrigerating fans, simultaneously, thereby improving the cooling speed.

Another object of the invention is to provide a refrigerator having H.M. cycle and control method thereof for operating the freezing and refrigerating fans, in a manner that if the temperature of the freezing evaporator is the freezing one, the operation of the freezing fan is delayed until the temperature of the refrigerating evaporator becomes below the refrigerating one, thereby saving the energy.

Another object of the invention is to provide a refrigerator having H.M. cycle and control method thereof for turning on a compressor according to the state of the freezing or refrigerating compartment and for controlling the freezing and refrigerating fans, independently, thereby maintaining each compartment at the set temperature.

Another object of the invention is to provide a refrigerator having H.M. cycle and control method thereof for first cooling the refrigerating compartment and then cooling the freezing compartment after the temperature of the refrigerating compartment becomes below the refrigerating set one, thereby decreasing the operating time of the compressor and saving the energy.

Another object of the invention is to provide a refrigerator having H.M. cycle and control method thereof for enabling the refrigerating compartment to be maintained at the constant temperature even during the cooling of the freezing compartment.

Another object of the invention is to provide a refrigerator having H.M. cycle and control method thereof for cooling the refrigerating compartment at the initial operation, so that the freeing compartment is cooled before the refrigerating compartment is cooled below the refrigerating temperature, thereby improving the cooling speed of both compartments.

Another object of the invention is to provide a refrigerator having H.M. cycle and control method thereof for preventing the temperature of the freezing compartment from being exceeded over the freezing set one even during the cooling of the refrigerating compartment, thereby performing the cooling of the refrigerating compartment at the constant temperature.

Another object of the invention is to provide a refrigerator having H.M. cycle and control method thereof for enabling the freezing compartment to be maintained at the constant temperature even during the cooling of the refrigerating compartment as well as for enabling the refrigerating compartment to be maintained at the constant temperature even during the cooling of the freezing compartment.

SUMMARY OF INVENTION

Accordingly, a refrigerator having H.M. cycle according to the invention having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, and a control portion for controlling the operation of the compressor and the freezing and refrigerating fans.

The invention furthermore comprises a first sensor for detecting the temperature of the refrigerating compartment, a second sensor for detecting the temperature of the freezing compartment and the control portion electrically connected to the first and second sensors to control the operation of the freezing and refrigerating fans according to the detected temperature.

The invention furthermore comprises a first sensor for detecting the surface temperature of the first evaporator, a second sensor for detecting the surface temperature of the second evaporator and the control portion for turning on the refrigerating fan and turning off the compressor and the freezing fan to perform the defrosting of the first evaporator, when the refrigerating temperature is over the refrigerating surface one during the non-operating of the compressor.

The invention furthermore comprises a sensor for detecting the temperature of open air out of the refrigerator and the control portion for performing the operation of the freezing and refrigerating fans, simultaneously, to cool both compartments or for performing the operation of any one of the freezing and refrigerating fans to first cool one compartments if the state of open air is not an overload previously set based on the inherent properties of the refrigerator and the state of the compartment is off out of the set temperature range for properly storing foodstuffs therein.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors to control the compressor and the freezing and refrigerating fans to be turned on, if the freezing temperature detected by the second sensor is over the freezing set one appropriate for storing foodstuffs in the freezing compartment and the refrigerating temperature detected by the first sensor is over the refrigerating set one appropriate for storing foodstuffs in the refrigerating compartment.

A control method of the refrigerator comprises steps of: comparing the freezing temperature with the freezing set one appropriate for storing foodstuffs in the freezing compartment, comparing the refrigerating temperature with the refrigerating set one appropriate for storing foodstuffs in the refrigerating compartment and operating the compressor and the corresponding fan to cool the refrigerating and/or freezing compartment, thereby performing the constant temperature and the high humidity in each of independently divided compartment, if any one of the refrigerating and freezing temperatures is over their set ones at said steps.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the compressor and the freezing and refrigerating fans to be turned on, if the freezing temperature detected by the second sensor is over the freezing set one appropriate for storing foodstuffs in the freezing compartment and the refrigerating temperature detected by the first sensor is over the refrigerating set one appropriate for storing foodstuffs in the refrigerating compartment, and for controlling the freezing fan so that the operation of the freezing fan is delayed by the predetermined time until the second surface temperature becomes below the refrigerating one, if the second surface temperature is over the refrigerating one.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment if the freezing temperature is over the freezing set one; comparing the freezing temperature with the freezing surface one, if the refrigerating temperature is over the refrigerating set one; turning on the compressor and the refrigerating fan and turning off the freezing fan, if the freezing temperature is below the freezing set one; and turning on the compressor and the freezing and refrigerating fans if the freezing temperature is over the freezing set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the compressor to be turned on, if the freezing temperature detected by the second sensor is over the freezing set one appropriate for storing foodstuffs in the freezing compartment, or if the refrigerating temperature detected by the first sensor is over the refrigerating set one appropriate for storing foodstuffs in the refrigerating compartment, and for controlling the freezing and refrigerating fans to be turned on and/off according to the current state of each compartment.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment if the freezing temperature is over the freezing set one; and turning on the compressor, if the freezing temperature is over the freezing set one, or if the refrigerating temperature is over the refrigerating set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the compressor and the refrigerating fan to be turned on, thereby cooling the refrigerating compartment, if the freezing temperature detected by the second sensor is over the freezing set one appropriate for storing foodstuffs in the freezing compartment, or if the refrigerating temperature detected by the first sensor is over the refrigerating set one appropriate for storing foodstuffs in the refrigerating compartment, and for controlling the compressor and the freezing fan to be turned on, thereby cooling the freezing compartment, if the refrigerating temperature is over the refrigerating set one.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment if the freezing temperature is over the freezing set one; and turning on the compressor and the refrigerating fan and turning off the freezing fan, if the refrigerating temperature is over the refrigerating set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the compressor and the freezing and refrigerating fans to be turned on, thereby performing the freezing and refrigerating compartments to be cooled at the constant temperature, if the refrigerating temperature is over the refrigerating set one appropriate for storing foodstuffs in the refrigerating compartment during the cooling of the freezing compartment.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment if the freezing temperature is over the freezing set one; turning on the compressor and the refrigerating fan and turning off the freezing fan, if the refrigerating temperature is over the refrigerating set one; turning on the compressor and the freezing fan and turning off the refrigerating fan, if the refrigerating temperature is below the refrigerating set one; and comparing the refrigerating temperature with the refrigerating set and then turning on the compressor and the freezing and refrigerating fans, if the refrigerating temperature is over the refrigerating set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the freezing and refrigerating fans to be turned on, thereby improving the cooling of the freezing compartment, if the refrigerating temperature is over a second refrigerating set one which is higher than the refrigerating temperature set appropriate for storing foodstuffs in the refrigerating compartment during the cooling of the refrigerating compartment.

A control method of the refrigerator comprises steps of: comparing the freezing temperature with the freezing set one appropriate for storing foodstuffs in the freezing compartment; turning on the compressor and the refrigerating fan and turning off the freezing fan, if the freezing temperature is over the freezing set one; comparing the refrigerating temperature with the second refrigerating set one which is higher than the refrigerating temperature set appropriate for storing foodstuffs in the refrigerating compartment; turning on the compressor and the refrigerating fan and turning off the freezing fan, if the refrigerating temperature is over the second refrigerating set one; and turning on the compressor and the freezing and refrigerating fans, if the refrigerating temperature is below the second refrigerating set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the freezing and refrigerating fans to be turned on, thereby preventing the refrigerating temperature from being increased over the predetermined range, if the refrigerating temperature is over a second refrigerating set one which is higher than the refrigerating temperature set appropriate for storing foodstuffs in the refrigerating compartment during the cooling of the refrigerating compartment.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment, if the freezing temperature is over the freezing set one; turning on the compressor and the refrigerating fan and turning off the freezing fan, if the refrigerating temperature is over the refrigerating set one; turning on the compressor and the freezing fan and turning off the refrigerating fan, if the refrigerating temperature is below the refrigerating set one; comparing the freezing temperature with a second freezing set one which is higher than the freezing temperature set appropriate for storing foodstuffs in the freezing compartment; comparing the refrigerating temperature with the refrigerating set one, if the freezing temperature is below the second freezing set one; and turning on the compressor and the freezing and refrigerating fans, if the freezing temperature is over the second freezing set one.

According to another embodiment of the invention, a refrigerator having freezing and refrigerating compartments comprises a refrigerating cycle including a compressor for compressing refrigerant, a condenser for condensing refrigerant, a capillary tube for expanding refrigerant, a first evaporator mounted in the refrigerating compartment and a second evaporator mounted in series to the first evaporator in the freezing compartment; the freezing and refrigerating compartments divided from each other to be cooled, separately, a first fan mounted in the refrigerating compartment to circulate air passing through the first evaporator, a second fan mounted in the freezing compartment to circulate air passing through the second evaporator, a first sensor for detecting the temperature of the refrigerating compartment, a second sensor for detecting the temperature of the freezing compartment and a control portion electrically connected to the sensors for controlling the freezing and refrigerating fans to be turned on, thereby preventing the freezing temperature from being increased over the predetermined range, if the freezing temperature is over the second freezing set one which is higher than the freezing temperature set appropriate for storing foodstuffs in the freezing compartment during the cooling of the refrigerating compartment, and for controlling the freezing and refrigerating fans to be turned on, thereby performing the freezing and refrigerator temperatures to be maintained at the constant temperature, if the refrigerating temperature is over the second refrigerating set one which is higher than the refrigerating temperature set appropriate for storing foodstuffs in the refrigerating compartment during the cooling of the freezing compartment.

A control method of the refrigerator comprises steps of: comparing the freezing temperature with the freezing set one appropriate for storing foodstuffs in the freezing compartment; comparing the refrigerating temperature with the refrigerating set one appropriate for storing foodstuffs in the refrigerating compartment, if the freezing temperature is over the freezing set one; turning on the compressor and the refrigerating fan and turning off the freezing fan, if the refrigerating temperature is over the refrigerating set one; turning on the compressor and the freezing fan and turning off the refrigerating fan, if the refrigerating temperature is below the refrigerating set one; comparing the freezing temperature with the second freezing set one which is higher than the freezing temperature set appropriate for storing foodstuffs in the freezing compartment after turning on the compressor and the refrigerating fan and turning off the freezing fan; returning to step to compare the refrigerating temperature with the refrigerating set one, if the freezing temperature is below the second freezing set one; turning on the compressor and the freezing and refrigerating fans, if the freezing temperature is over the second freezing set one; comparing the refrigerating temperature with the refrigerating set one, again; turning on the compressor and the freezing fan and turning off the refrigerating fan, if the refrigerating temperature is below the refrigerating set one; comparing the freezing temperature with the freezing set one, again, if the refrigerating temperature is over the refrigerating set one; turning on the compressor and the freezing and the refrigerating fans, if the freezing temperature is over the freezing set one; turning off the compressor and the freezing and the refrigerating fans, if the freezing temperature is below the freezing set one; comparing the freezing temperature with the second freezing set one, if the freezing temperature is over the freezing set one after turning on the compressor and the freezing fan and turning off the refrigerating fan; comparing the refrigerating temperature with the refrigerating set one, if the freezing temperature is over the freezing set one; turning on the compressor and the freezing fan and turn off the refrigerating fan, if the freezing temperature is over the second freezing set one; and turning on the compressor and the freezing and refrigerating fans, if the freezing temperature is below the second freezing set one;

BRIEF DESCRIPTION OF THE DRAWINGS

The invention now will be described in detail with reference to the accompanying drawings, in which.

DETAILED DESCRIPTION OF INVENTION

A refrigerating having H.M. cycle according to the invention now will be described in detailed with reference to FIGS. 4, 5 and 6.

Figure 1:
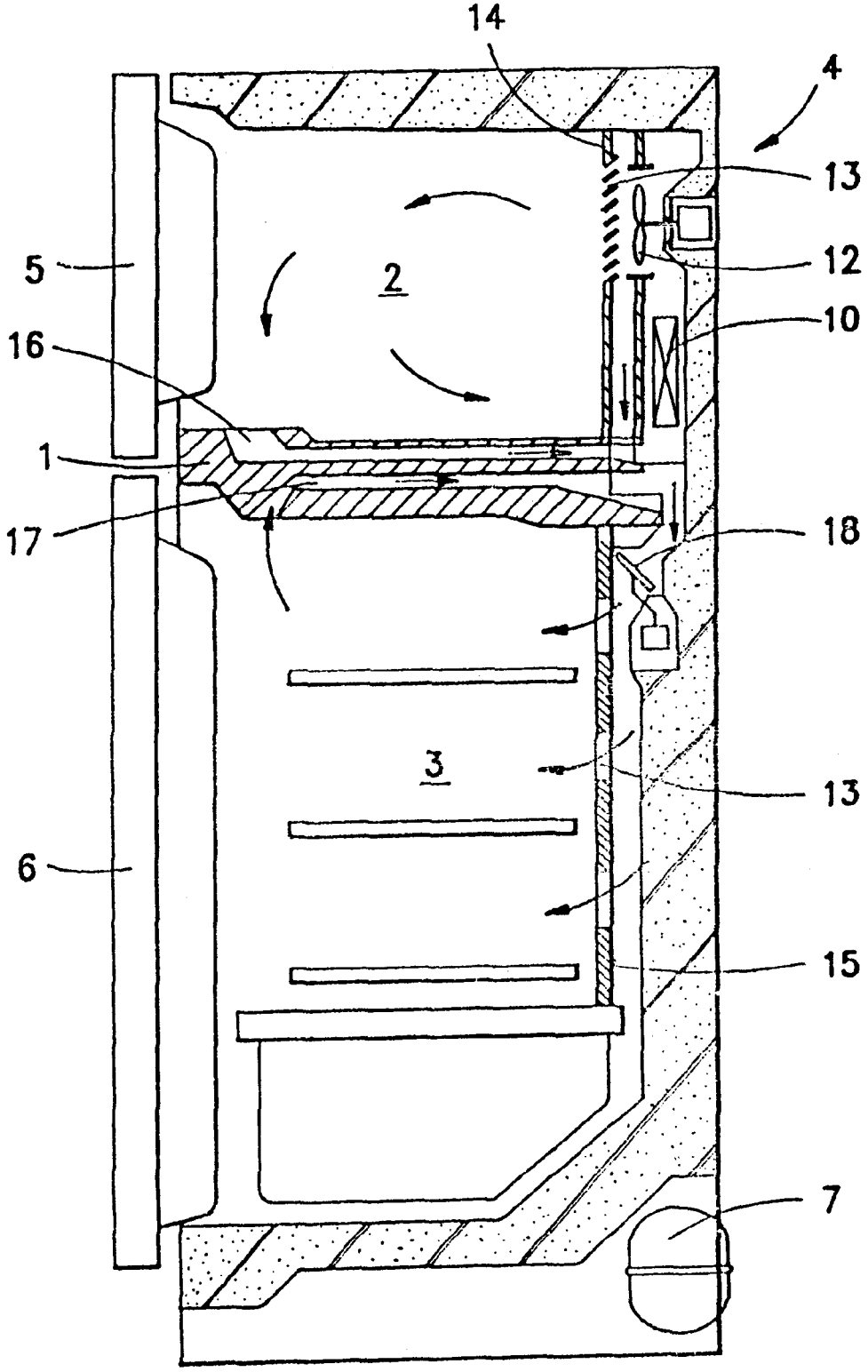
FIG. 1 (PRIOR ART)
FIG. 1 is a side elevate cross-sectional view illustrating the configuration of a conventional refrigerator.
Figure 2:
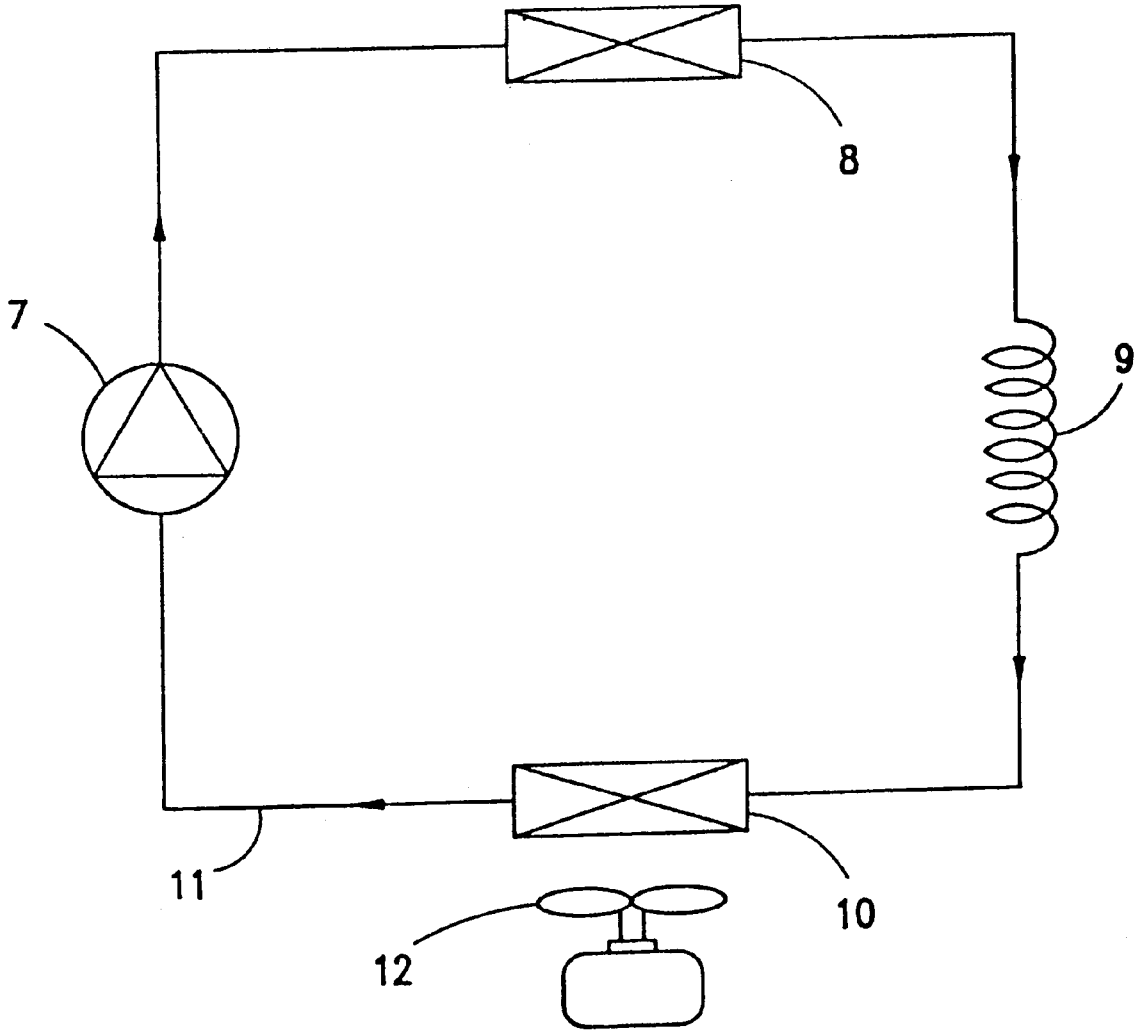
FIG.2 (PRIOR ART)
FIG. 2 is a block diagram of a refrigerating cycle adapted to the conventional refrigerator of FIG. 1.
Figure 3:
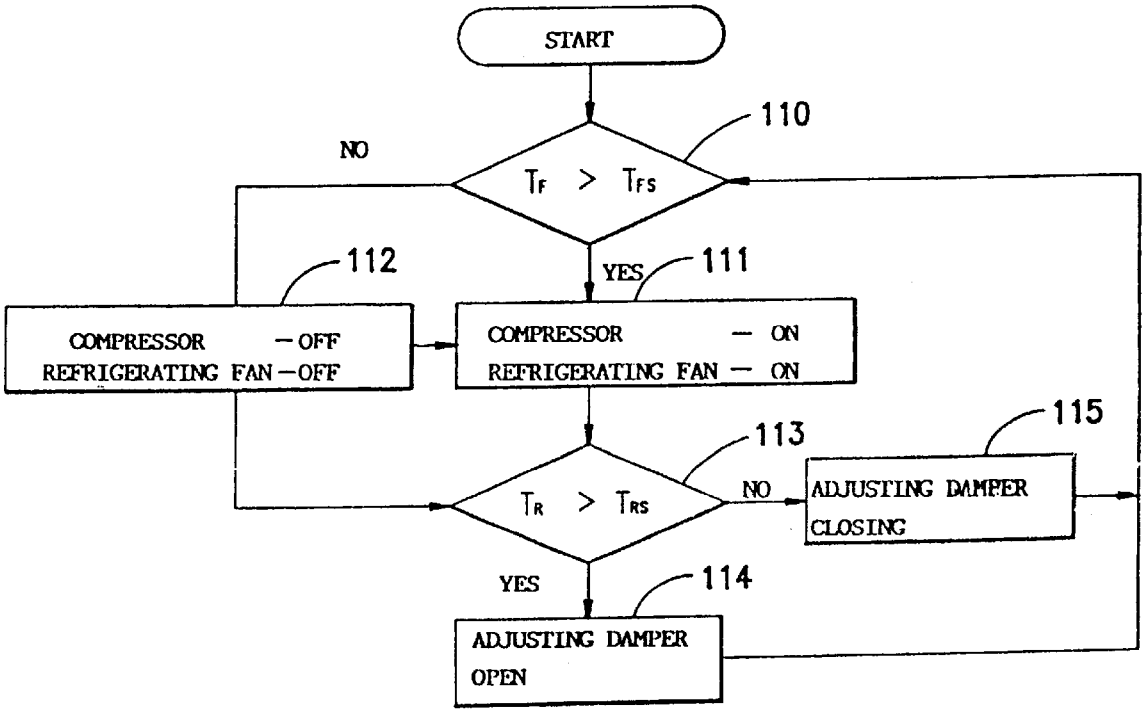
FIG.3 (PRIOR ART)
FIG. 3 is a flow chart illustrating a control method for the conventional refrigerator of FIG. 1.
Figure 4:
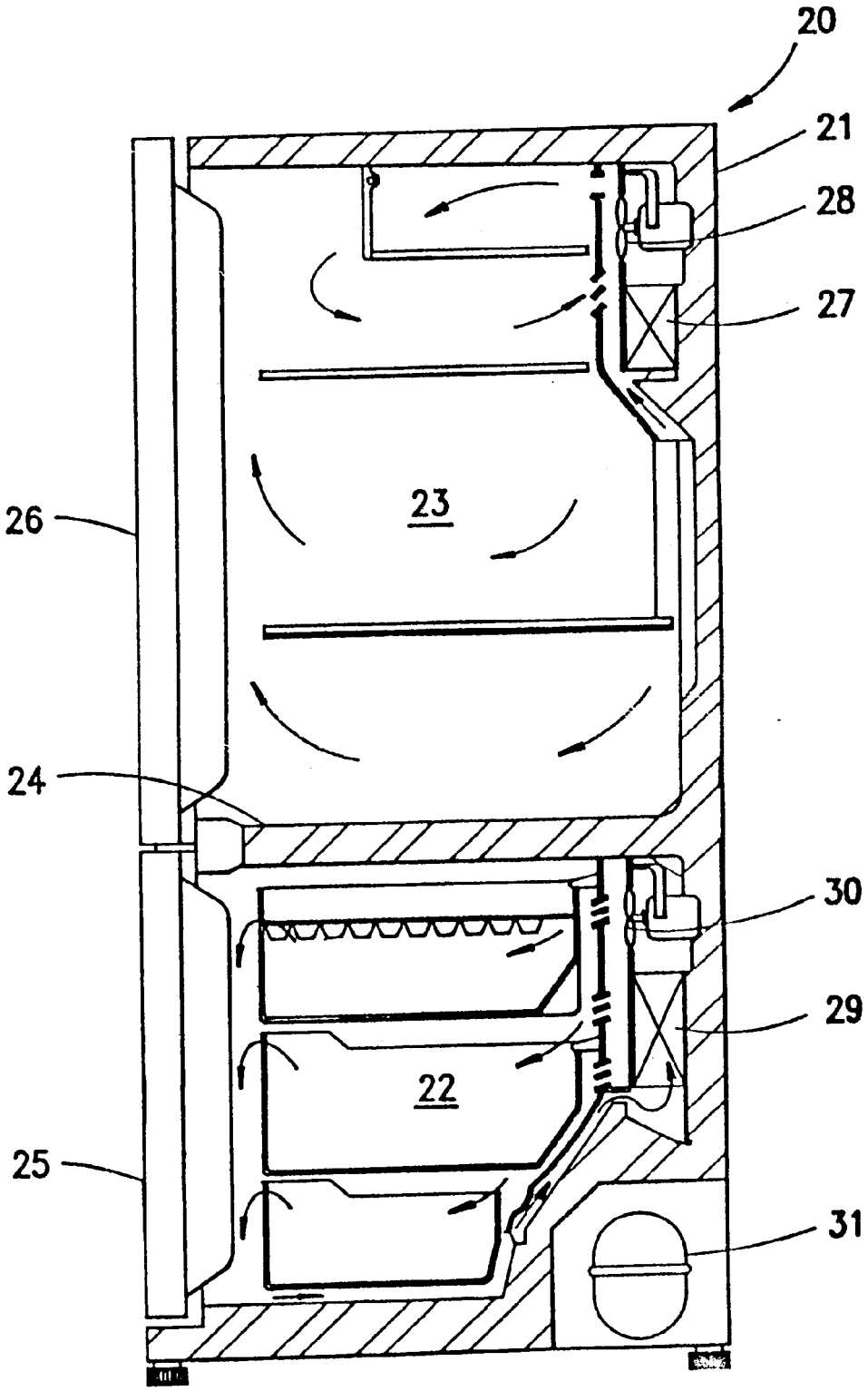
FIG. 4 is a side elevate cross-sectional view illustrating the configuration of a refrigerator having H.M. cycle according to the invention.

As shown in FIG. 4, the refrigerator 20 having H.M. cycle comprises a body made of the thermal insulative configuration which is divided into a freezing compartment 22 formed on the lower portion thereof and a refrigerating compartment 23 formed on the upper portion thereof to prevent the mixing of cooled air generated in each compartments with each other. In other words, the freezing compartment 22 and the refrigerating compartment 23 are separated from each other by a middle partition wall 24, each of which is provided with a freezing door 25 and a refrigerating compartment door 26 so as to open/close them. Herein, it is noted that any cooled air flow path is not presented to communicate the freezing compartment and the refrigerating compartment with each other, while the middle partition wall 24 does not provide any feed-back passage therein unlike the prior art. A first heat-exchanger or evaporator 27 and a refrigerating compartment fan 28 (called refrigerating fan" below) are provided in the rear wall of the refrigerating compartment 23, and a first heat-exchanger or evaporator 29 and a freezing compartment fan 30(called "freezing fan" below) are mounted in the rear wall of the freezing compartment 22, in which each of the compartment fan includes a fan motor. A compressor 31 is mounted in the lower portion of the body 21.

Figure 5:
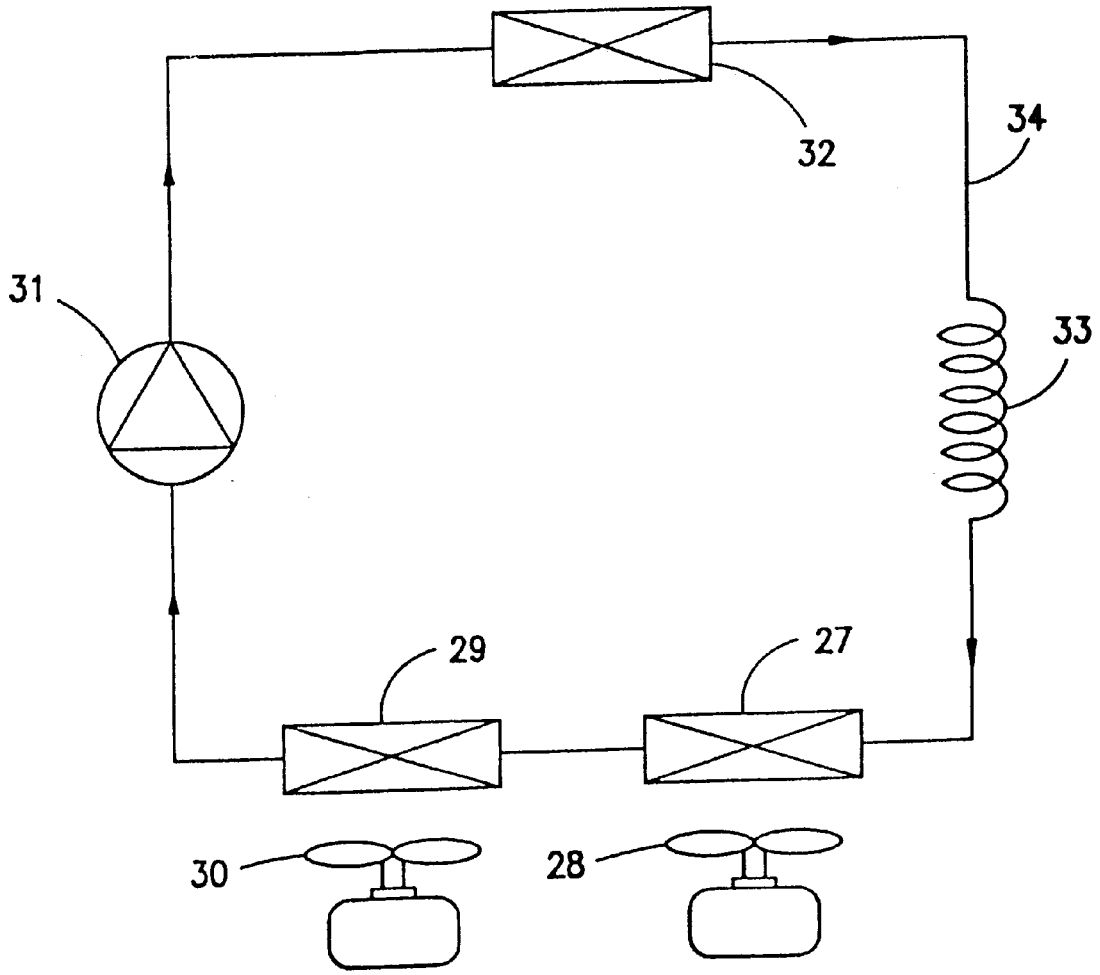
FIG. 5 is a block diagram of a refrigerating cycle adapted to the refrigerator of FIG. 4.

The refrigerating H.M. cycle of the refrigerator according to the invention is referred to FIG. 5. The compressor 31, a condenser 32, a capillary tube 33 and the first and second evaporators 27 and 29 are connected in turn to one another in order to form one closed loop. The refrigerating fan 28 and the freezing fan 30 are respectively mounted near to the first and second evaporators 27 and 29. As the refrigerant is flowed at the arrow direction to induce its own inherent phase changes, it is evaporated in part at the first and second evaporators 27 and 29 so as to absorb the heat from air and generate cooled air. The cooled airs are circulated in the refrigerating compartment 23 and the freezing compartment 22 by means of the refrigerating fan 28 and the freezing fan 30, respectively.

The refrigerator use one refrigerant, for example CFC-12 or HFC-134a, etc. The phase change of the refrigerant is explained as follows: the refrigerant is compressed at the high temperature and the high pressure at the compressor 31. The compressed refrigerant is flowed into the condenser 32 to be condensed by being heat-exchanged with the peripheral air. The refrigerant passes through the capillary tube 33 or an expansion valve to be reduced at pressure. And then the refrigerant is evaporated passing in turn through the first and second evaporators 27 and 29, in which the first and second evaporators 27 and 29 are connected in series to each other without any structure being not installed therebetween. Therefore, the refrigerant passing through the first evaporator 27 is evaporated in part and then directed to the second evaporator 29 so as to gasify the remainder refrigerant. The completely gasified refrigerant is supplied to the compressor 31, thereby finishing one refrigerating H.M. cycle. The refrigerating H.M. cycle is repeated based on the operation of the compressor 31.

As described above, the refrigerator having H.M. cycle includes two evaporator and two fans and uses one refrigerant as an operating fluid. Accordingly, it does not require components such as a gas-liquid separator between the evaporators or a valve for controlling the flowing direction of the refrigerant. The serial arrangement of the evaporators simplifies the pipe laying for the refrigerating H.M. cycle. The use of one refrigerant is very advantageous to the mass-production of the refrigerator, because the performance change of the refrigerating cycle does not represent slightly in the manufacturing procedures according to the distribution of the amount of the refrigerant enveloped, as if the mixture refrigerant is used. Even through one refrigerant is used, the evaporating temperature is changed according to the temperature of air passing through the evaporator, thereby decreasing the non-reversible loss of the thermal dynamics. In other words, as the temperature of air passing through the first evaporator is relatively higher, the evaporating temperature of the first evaporator is high. As the temperature of air passing through the second evaporator is relatively lower, the evaporating temperature of the second evaporator is low. Therefore, it can reduce the temperature difference between before and after the cooling operation so as to decrease the non-reversible loss of the thermal dynamics.

Figure 6:
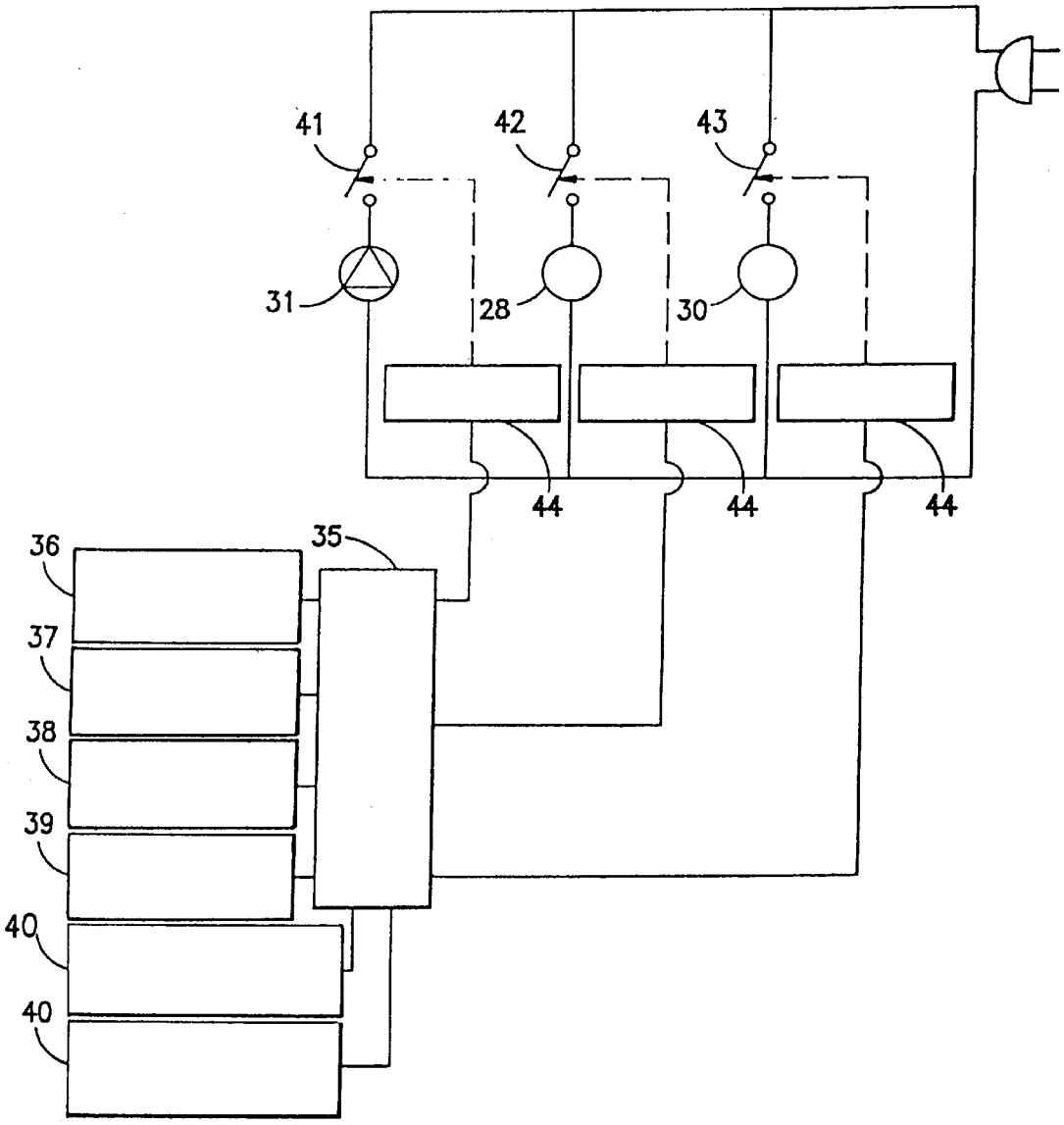
FIG. 6 is a block diagram illustrating a control portion of the refrigerating having H.M. cycle according to the invention.

Referring to FIG. 6, the control portion of a refrigerating having H.M. cycle according to the invention will be described as follows: A control portion 35 comprises a door switch 36 for detecting the opening or closing of a door, a refrigerating compartment temperature sensor 37 for detecting the temperature of a refrigerating compartment, a freezing compartment temperature sensor 38 for detecting the temperature of a freezing compartment, an open air temperature sensor 39, a first cooler surface temperature sensor 40 and a second cooler surface temperature sensor 40' connected to the inputting portion thereof, thereby inputting the electrical signals detected by the stitch and the sensors thereto. The control portion 35 also includes a first switch 41, a second switch 42 and a third switch 43 electrically connected to the outputting portion thereof, so that the compressor 31, the refrigerating fan 28 and the freezing fan 30 are respectively turned on or off. The first switch 41, the second switch 42 and the third switch 43 are controlled by the control portion 35 to turn on/off each of the compressor 31, the refrigerating fan 28 and the freezing fan 30. Thus, it enables the independent control of the compressor 31, the refrigerating fan 28 and the freezing fan 30.

The control portion 35 controls the operating of the compressor and the freezing and refrigerating fans in a manner that if the temperature detected by the freezing compartment sensor is over one previously set appropriate for storing freezing foods, the compressor and the freezing and refrigerating fans are turned on. On the contrary, if not, the compressor and the freezing and refrigerating fans are turned off. Herein, the set temperature of the freezing compartment means the temperature range of a compartment, for example −15° C. to −21° C. belonging to the freezing compartment, within the range of which a user can select any one of −21° C.(the strong freezing), −18° C.(the middle freezing) and −15° C.(the weak freezing). Also, the set temperature of the refrigerating compartment means the temperature range of a compartment, for example 6° C. to −1° C. belonging to the refrigerating compartment, within the range of which a user can select any one of −1° C.(the strong refrigerating), 3° C.(the middle refrigerating) and 6° C.(the weak refrigerating).

The control portion has another control method for a system in that when the temperature of the freezing compartment is over the freezing set one and the temperature of the refrigerating compartment is over the refrigerating set one, if the temperature detected by the second cooler surface temperature sensor is over that of the freezing compartment, it adjusts the operating time of the compressor and the freezing and refrigerating fans to be delayed till the temperature of the second cooler surface temperature sensor becomes lower than that of the freezing compartment.

The control portion has another control method for a system in that when the temperature of the freezing compartment is over the freezing set one and the temperature of the refrigerating compartment is over the refrigerating set one, the compressor is turned on, but each of the freezing and refrigerating fans is controlled according to the temperatures of the freezing and refrigerating compartments.

The control portion has another control method for a system in that when the temperature of the freezing compartment is over the freezing set one and the temperature of the refrigerating compartment is over the refrigerating set one, the compressor and the refrigerating fan are first turned on to cool the refrigerating compartment, and then if the temperature of the refrigerating compartment is below the refrigerating set one, the compressor and the freezing fan are turned on to cool the freezing compartment.

The control portion has another control method for a system in that when the temperature of the refrigerating compartment is over the refrigerating set one during cooling the freezing compartment, the compressor and the freezing fan are turned on along with the refrigerating fan to perform the constant temperature cooling of the freezing and refrigerating compartments.

The control portion has another control method for a system in that when the temperature of the refrigerating compartment becomes higher than the refrigerating set one by the predetermined temperature during cooling the refrigerating compartment at the time of the initial operation, the refrigerating fan is turned on along with the freezing fan to improve the cooling speeds of the freezing and refrigerating compartments. At that time, it is desirous that the temperature of the refrigerating compartment is higher than the refrigerating set one by 1° C. to 5° C., especially 2° C.

The control portion has another control method for a system in that when the temperature of the freezing compartment becomes higher than the freezing set one by the predetermined temperature during cooling the refrigerating compartment at the time of the normal operation, the freezing fan is turned on along with the refrigerating fan to perform the constant temperature cooling of the freezing and refrigerating compartments. At that time, it is desirous that the temperature of the freezing compartment is higher than the freezing set one by 1° C. to 5° C., especially 2° C.

The control portion has another control method for a system in that when the temperature of the freezing compartment becomes higher than the freezing set one by the predetermined temperature during cooling the refrigerating compartment at the time of the normal operation, the freezing fan is turned on along with the refrigerating fan to perform the constant temperature cooling of the freezing and refrigerating compartments. While, if the temperature of the refrigerating compartment becomes higher than the refrigerating set one by the predetermined temperature during cooling the freezing compartment at the time of the normal operation, the refrigerating fan is turned on along with the freezing fan to perform the constant temperature cooling of the freezing and refrigerating compartments. At that time, it is desirous that the temperatures of the freezing and refrigerating compartments are respectively higher than their own set ones by 1° C. to 5° C., especially 2° C.

Figure 9:
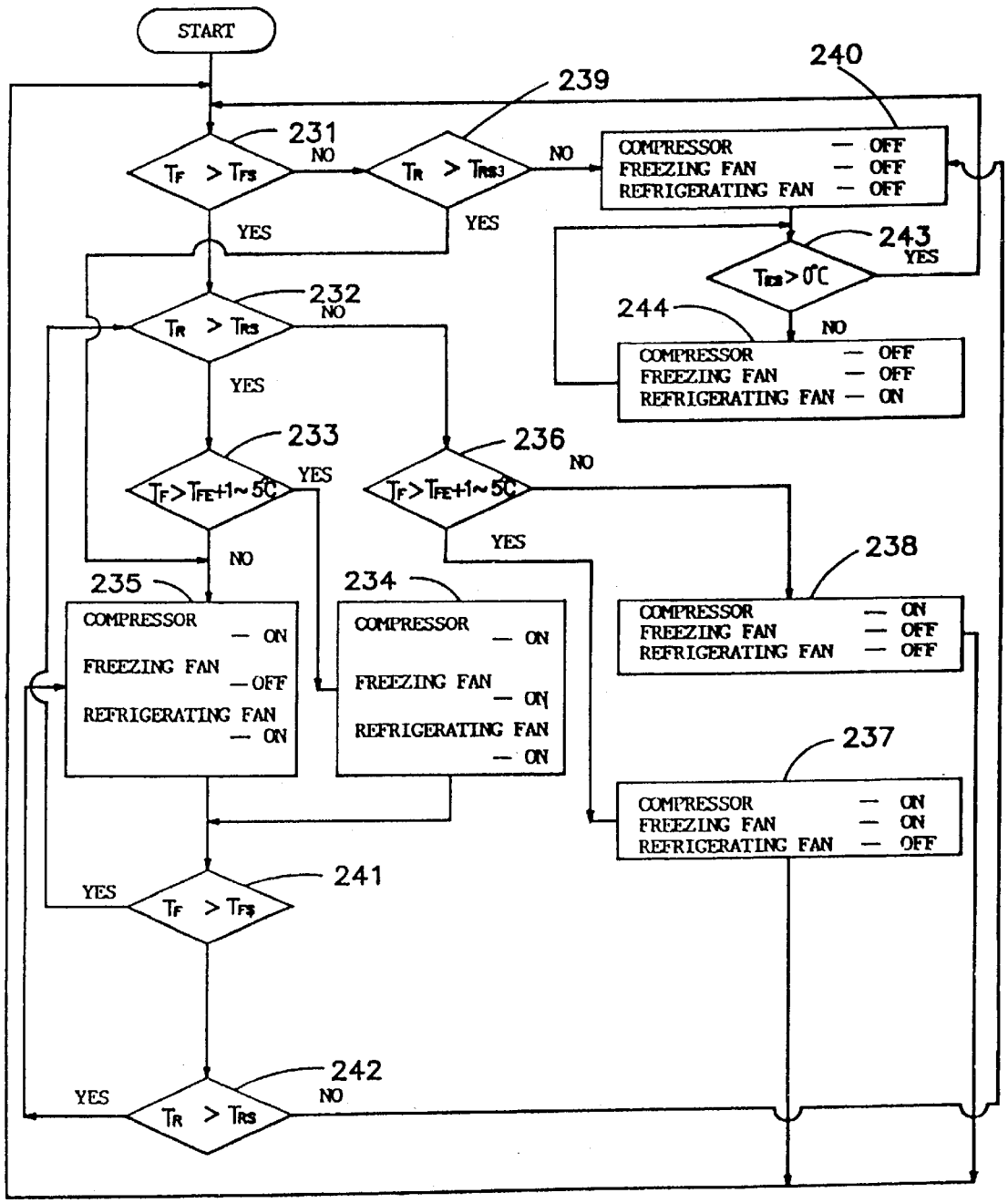
FIG. 9 is a flow chart illustrating a second embodiment of a control method of the refrigerating having H.M. cycle according to the invention.
Figure 22:
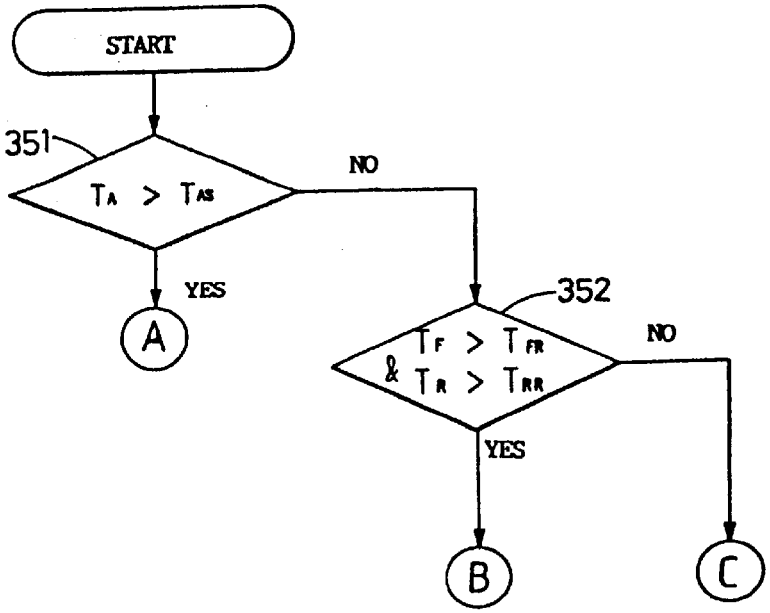
FIGS. 22, 23, 24 and 25 each is flow chart illustrating a ninth embodiment, tenth, eleventh and twelfth embodiments of a control method of the refrigerating having H.M. cycle according to the invention.

The control portion has another control method for a system in that it determines whether an open air state out of the refrigerator is an overload state previously set according to the properties of the refrigerator, and if the state of a compartment is beyond the set temperature predetermined to be appropriate for the storage of foods, but both compartments can be cooled, simultaneously, it is not the overload state. Thus, the freezing and refrigerating fans are operated together to perform the constant temperature cooling of the freezing and refrigerating compartments. If it is difficult to cool both compartments, together, only any one of the freezing and refrigerating fans is operated to perform the priority cooling of the corresponding compartment. Thus, if the open air state out of the refrigerator is a overload state, the compressor and the freezing and refrigerating fans are controlled according to one of methods as described above. Thereafter, the preferred embodiments according to the invention will be described in turns starting from initial operation modes including overload operation modes adapted to a number of embodiments indicating the normal operation modes of a refrigerator as follows:

According to a full automatic operation and control method thereof including the initial operation mode including the overload operation mode, as shown in FIG. 22, a first control performs step 351 to compare an open air temperature $T_A$ out of a refrigerator with the reference temperature of open air $T_{AS}$(called "reference temperature" below) which is considered as the standard of determining whether the open air state out of the refrigerator is an overload or not. In other words, the reference temperature means that open air does not have the high temperature to cause the overload operation of the refrigerator during the normal operation. Especially, the reference temperature can be suggested to gives some changes to the operating method of the refrigerator in the summer season, which is defined as the temperature range of about 30° C.–35° C. in this application, preferably 32° C. Of course, the temperature range is not limited to that, but changeable according to the performance and state of the refrigerator. If the open air temperature $T_A$ is over the reference temperature of open air $T_{AS}$, step 351 proceeds onto the routine A as shown in FIG. 9, which is the same as the second embodiment. The explanation of the routine A is omitted herein but will be described below in detail.

If the open air temperature $T_A$ is below the reference temperature of open air $T_{AS}$, step 351 goes onto step 352 to compare the freezing temperature $T_F$ with the freezing reference temperature $T_{FR}$ and the refrigerating temperature $T_R$ with the refrigerating reference temperature $T_{RR}$. Herein, it is noted that the definition of the reference temperature is for providing another temperature range similar to the temperature range of a compartment within the predetermined range off out of a set temperature range. For example, the refrigerating reference temperature is defined as the temperature range from the temperature off out of a refrigerating set temperature to the temperature that users seem to be felt like warming air. At that time, the preferable temperature range is 7° C. to 15° C., more preferably 10° C. Also, the freezing reference temperature is defined as the temperature range from the temperature off out of a freezing set temperature to the temperature that ices are formed in the freezing compartment. At that time, the temperature range is −14° C. to −5° C., preferably −10° C.

Figure 16:
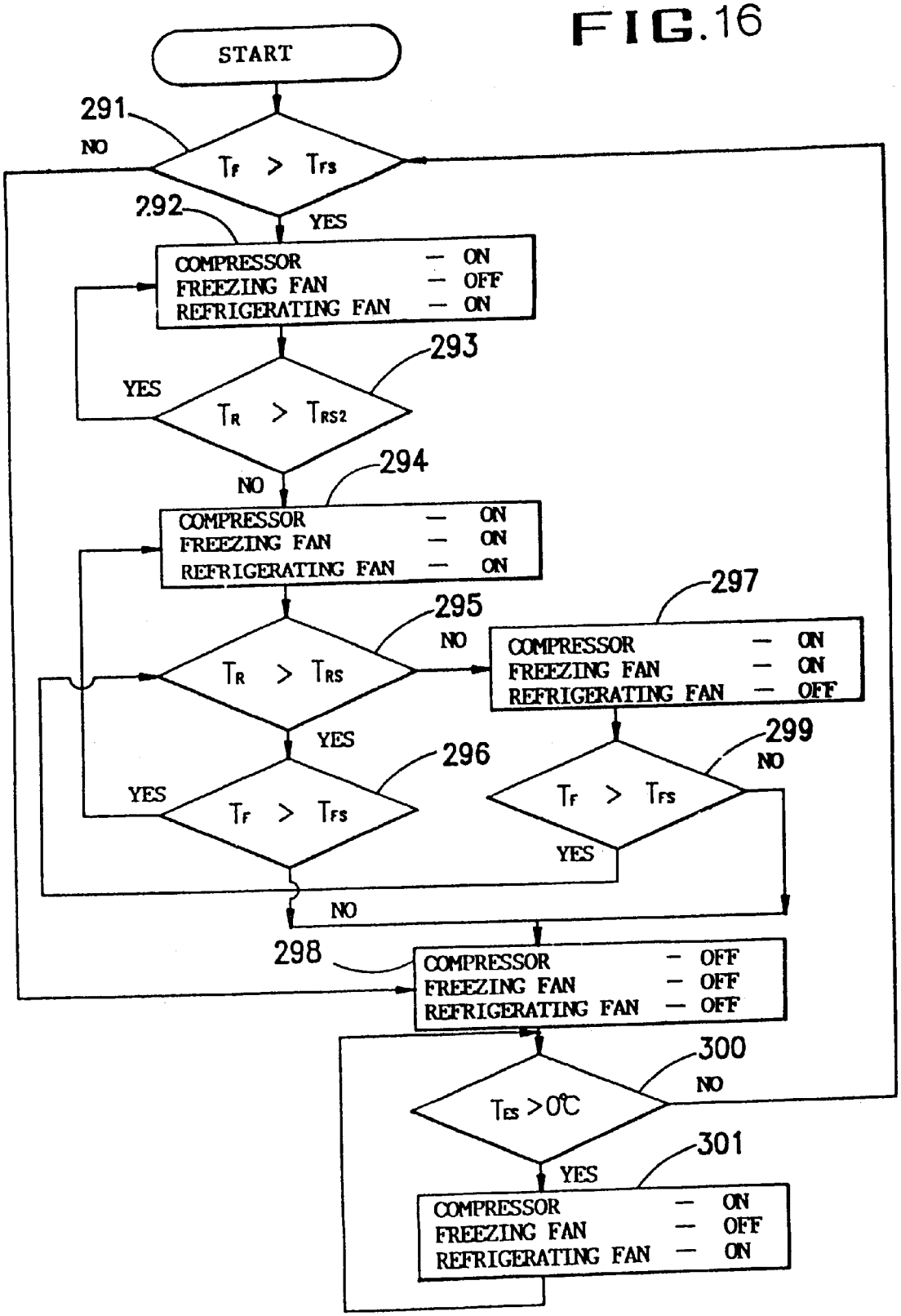
FIG. 16 is a flow chart illustrating a sixth embodiment of a control method of the refrigerating having H.M. cycle according to the invention.

If the freezing temperature $T_F$ is over the freezing reference temperature $T_{FR}$ and the refrigerating temperature $T_R$ is over the refrigerating reference temperature $T_{RR}$, step 352 proceeds onto the routine B as shown in FIG. 16, which is the same as the sixth embodiment. The explanation of the routine B is omitted herein but will be described below in detail.

If the freezing temperature $T_F$ is below the freezing reference temperature $T_{FR}$ or the refrigerating temperature $T_R$ is below the refrigerating reference temperature $T_{RR}$, step 352 proceeds onto the routine C as shown in FIG. 9, which is the same as the second embodiment. The explanation of the routine C is omitted herein but will be described below in detail.

As described above, according to the first control of the initial operation mode, if the open air temperature is over the reference temperature, the freezing and refrigerating compartments are cooled, simultaneously. At that time, if the temperature of the second evaporator is over the freezing one, the operation of the freezing fan is delayed until the surface temperature of the second evaporator becomes below the freezing one. It prevents the reverse effect of increasing the temperature of the freezing compartment. Also, if the open air temperature is over the reference temperature, it is determined whether the temperature of each compartment is over their reference temperature. At that time, if the temperature of each compartment is below their reference temperature, the freezing and refrigerating compartments all are cooled at the same time at the first timing point to reach their set temperatures. But, if the freezing and refrigerating compartments all are cooled, when the temperature of each compartment is over their reference temperature, any one of the freezing and refrigerating compartments must be first cooled since it is difficult to cool the compartments by their set temperatures. Therefore, the ninth embodiment enables one compartment to first be cooled and then another compartment to be cooled, so that both compartments can be quickly cooled to arrive at their set temperatures.

Figure 11:
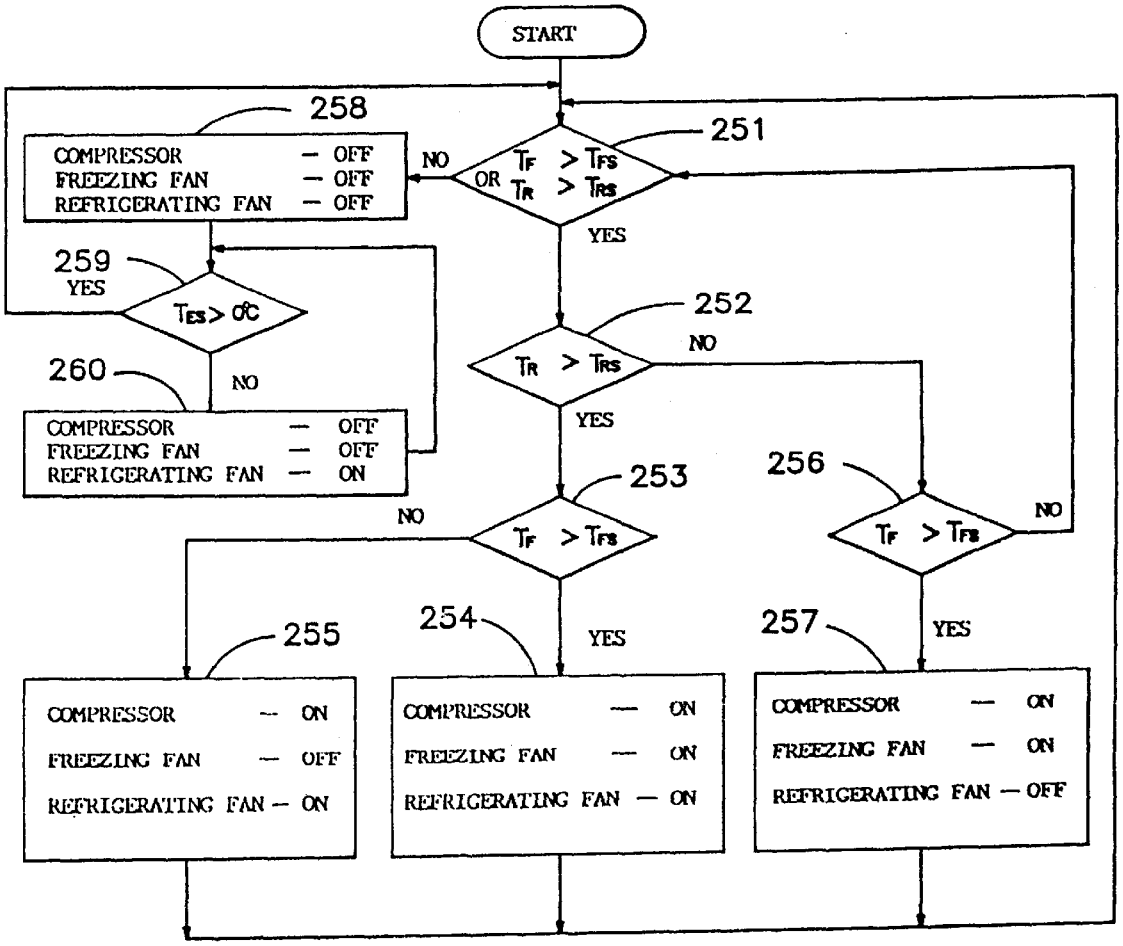
FIG. 11 is a flow chart illustrating a third embodiment of a control method of the refrigerating having H.M. cycle according to the invention.
Figure 23:
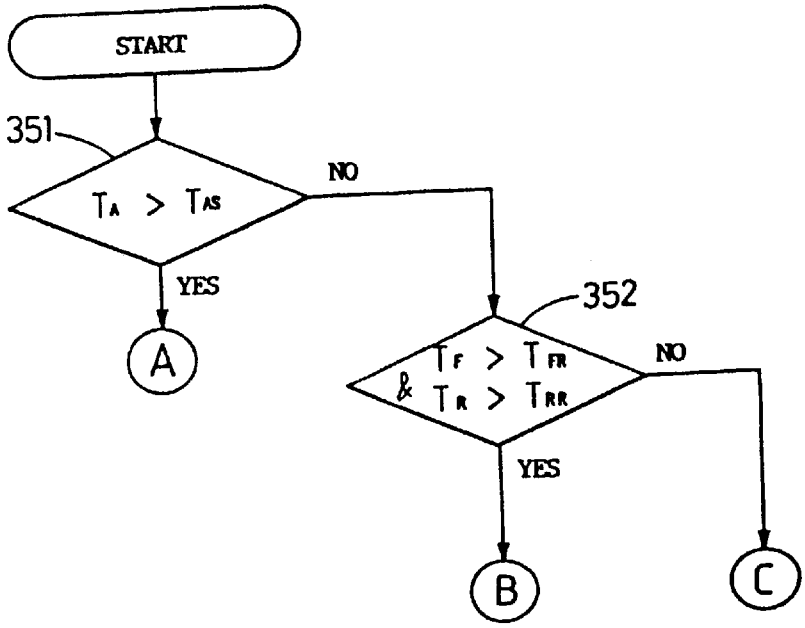

Referring to FIG. 23, a second control performs step 351 to compare an open air temperature $T_A$ out of a refrigerator with a reference temperature of open air $T_{AS}$. If the open air temperature $T_A$ is over the reference temperature of open air $T_{AS}$, step 351 proceeds onto the routine A as shown in FIG. 11, which is the same as the third embodiment. The explanation of the routine A is omitted herein, but will be described below in detail.

If the open air temperature $T_A$ is below the reference temperature of open air $T_{AS}$, step 351 goes onto step 352 to compare the freezing temperature $T_F$ with the freezing reference temperature $T_{FR}$ and the refrigerating temperature $T_R$ with the refrigerating reference temperature $T_{RR}$. Thereafter, if the freezing temperature $T_F$ is over the freezing reference temperature $T_{FR}$ and the refrigerating temperature $T_R$ is over the refrigerating reference temperature $T_{RR}$, step 352 proceeds onto the routine B as shown in FIG.

16, which is the same as the sixth embodiment. The explanation of the routine B is omitted herein but will be described below in detail.

If the freezing temperature $T_F$ is below the freezing reference temperature $T_{FR}$ or the refrigerating temperature $T_R$ is below the refrigerating reference temperature $T_{RR}$, step 352 proceeds onto the routine C as shown in FIG. 9, which is the same as the second embodiment. The explanation of the routine C is omitted herein but will be described below in detail.

As described above, according to the second control of the initial operation mode, if the open air temperature is over the reference one, the freezing and refrigerating compartments are cooled, separately. Then, when the open air temperature is below the reference one, it is determined whether the temperature of each compartment is below their reference one. If the temperature of each compartment is below their reference one, the freezing and refrigerating compartments all are cooled from the first to reach their set temperatures. If the temperature of each compartment is over their reference one, any one of the freezing and refrigerating compartments is first cooled, so that both compartments can be quickly cooled to arrive at their set temperatures.

Figure 14:
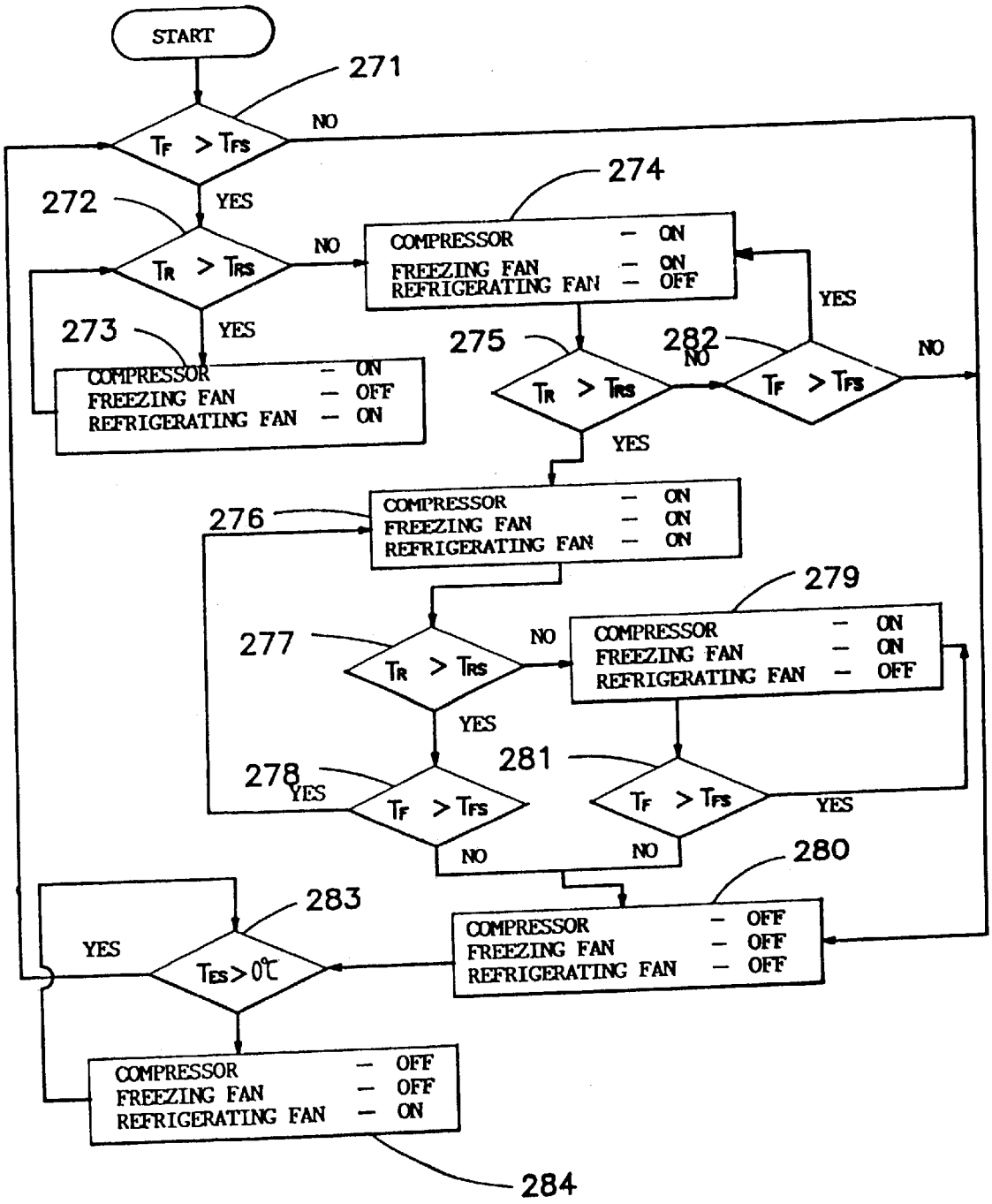
FIG. 14 is a flow chart illustrating a fifth embodiment of a control method of the refrigerating having H.M. cycle according to the invention.
Figure 24:
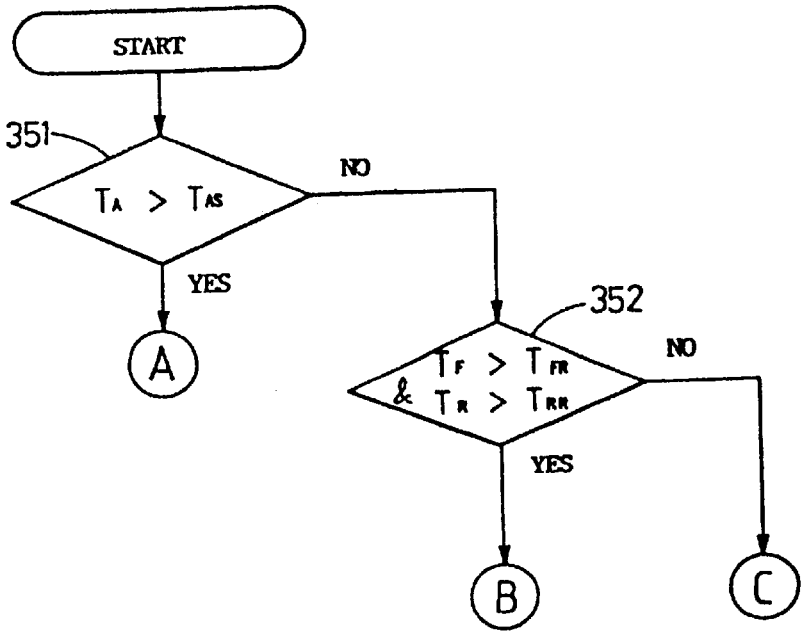

Referring to FIG. 24, a third control performs step 351 to compare a open air temperature $T_A$ out of a refrigerator with the reference temperature of open air $T_{AS}$. If the open air temperature $T_A$ is over the reference temperature of open air $T_{AS}$, step 351 proceeds onto the routine A as shown in FIG. 14, which is the same as the fifth embodiment. The explanation of the routine A is omitted herein but will be described below in detail.

If the open air temperature $T_A$ is below the reference temperature of open air $T_{AS}$, step 351 goes onto step 352 to compare the freezing temperature $T_F$ with the freezing reference temperature $T_{FR}$ and the refrigerating temperature $T_R$ with the refrigerating reference temperature $T_{RR}$. Thereafter, if the freezing temperature $T_F$ is over the freezing reference temperature $T_{FR}$ and the refrigerating temperature $T_R$ is over the refrigerating reference temperature $T_{RR}$, step 352 proceeds onto the routine B as shown in FIG. 16, which is the same as the sixth embodiment. The explanation of the routine B is omitted herein but will be described below in detail.

If the freezing temperature $T_F$ is below the freezing reference temperature $T_{FR}$ or the refrigerating temperature $T_R$ is below the refrigerating reference temperature $T_{RR}$, step 352 proceeds onto the routine C as shown in FIG. 9, which is the same as the second embodiment. The explanation of the routine C is omitted herein but will be described below in detail.

As described above, according to the third control of the initial operation mode, if the open air temperature is over the reference one, under the abnormal condition of the freezing and refrigerating compartments the refrigerating compartment is first cooled, and then the freezing compartment is cooled when the refrigerating temperature becomes below the refrigerating set one. Thereafter, when the open air temperature is below the reference one, it is determined whether the temperature of each compartment is below their reference temperature. If the temperature of each compartment is below their reference one, the freezing and refrigerating compartments all are cooled from the first to reach their set temperatures. If the temperature of each compartment is over their reference one, any one of the freezing and refrigerating compartments is first cooled, so that both compartments can be quickly cooled to arrive at their set temperatures.

Figure 20:
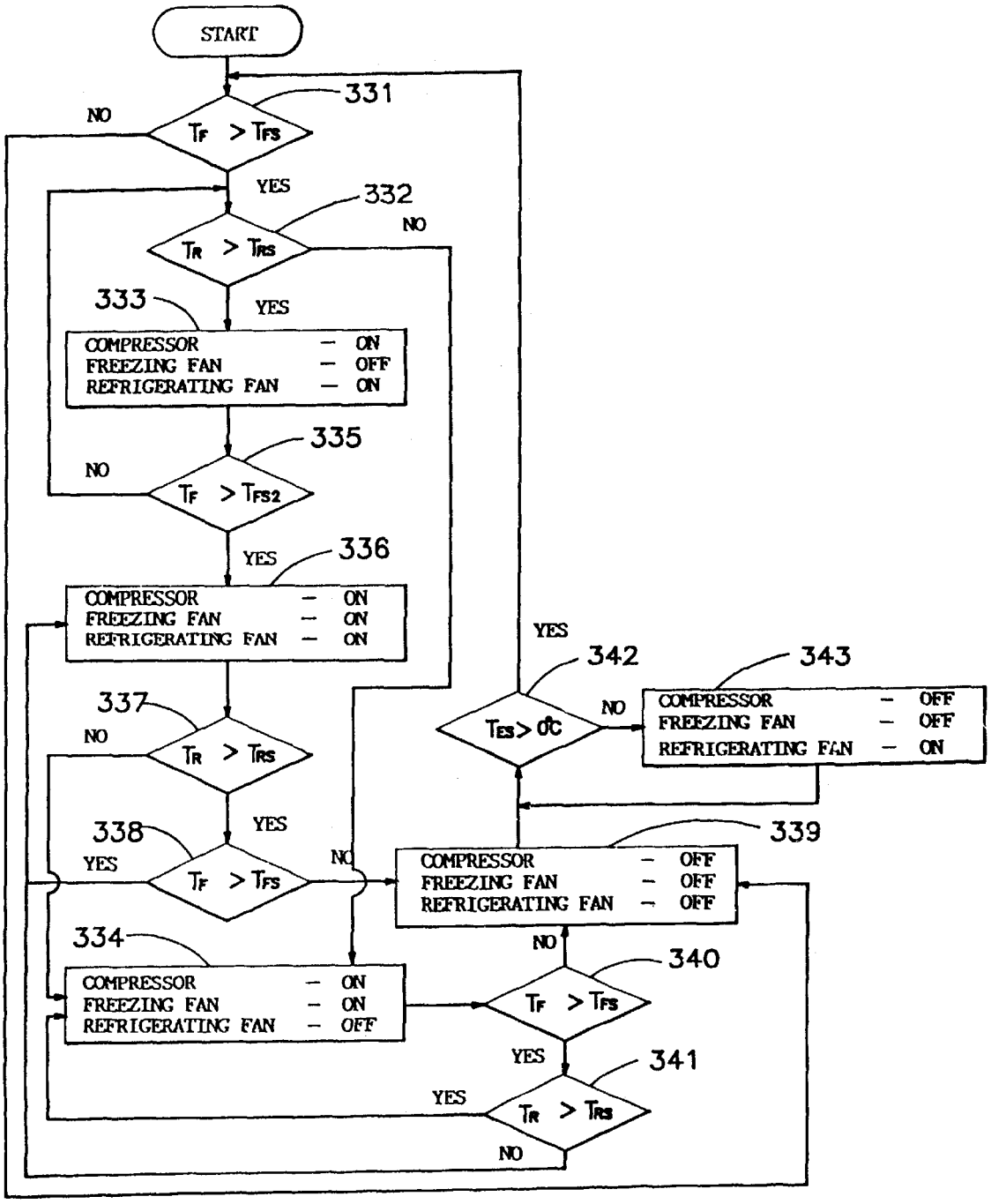
FIG. 20 is a flow chart illustrating an eighth embodiment of a control method of the refrigerating having H.M. cycle according to the invention.
Figure 25:
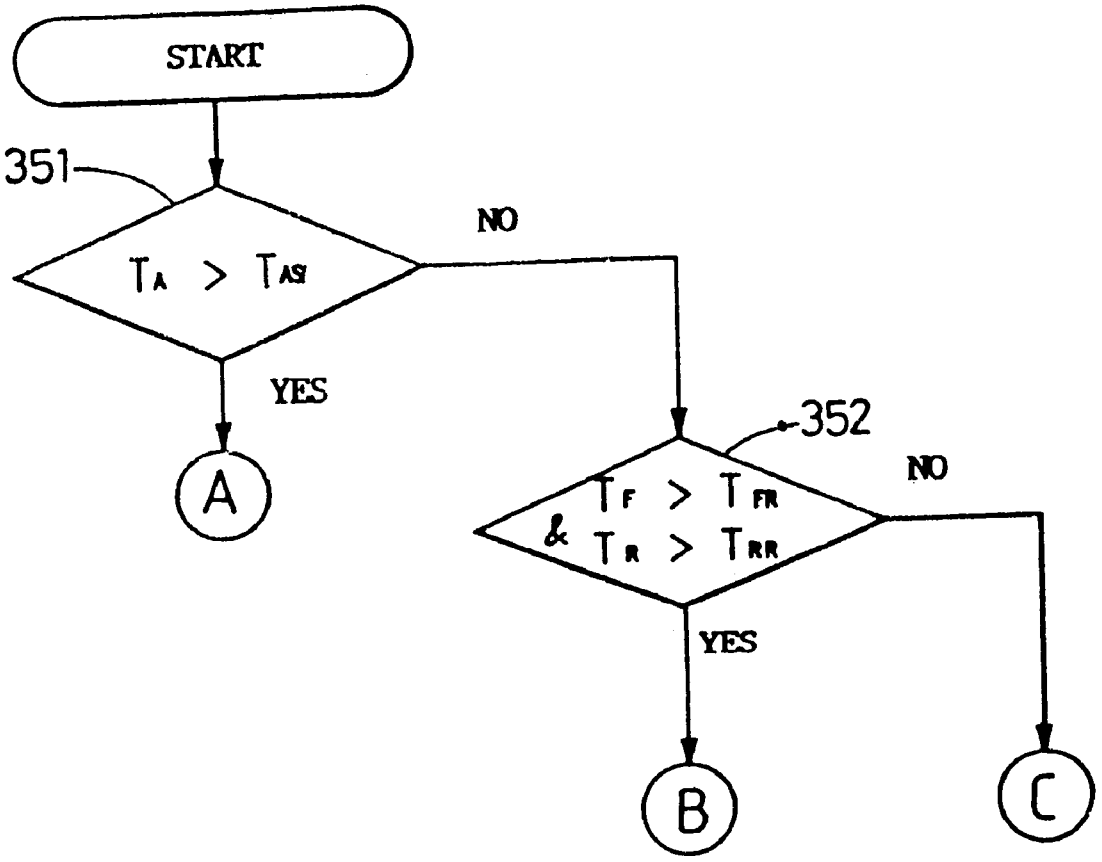

Referring to FIG. 25, a fourth control performs step 351 to compare a open air temperature $T_A$ out of a refrigerator with the reference temperature of open air $T_{AS}$. If the open air temperature $T_A$ is over the reference temperature of open air $T_{AS}$, step 351 proceeds onto the routine A as shown in FIG. 20, which is the same as the eighth embodiment. The explanation of the routine A is omitted herein but will be described below in detail.

If the open air temperature $T_A$ is below the reference temperature of open air $T_{AS}$, step 351 goes onto step 352 to compare the freezing temperature $T_F$ with the freezing reference temperature $T_{FR}$ and the refrigerating temperature $T_R$ with the refrigerating reference temperature $T_{RR}$. Thereafter, if the freezing temperature $T_F$ is over the freezing reference temperature $T_{FR}$ and the refrigerating temperature $T_R$ is over the refrigerating reference temperature $T_{RR}$, step 352 proceeds onto the routine B as shown in FIG. 16, which is the same as the sixth embodiment. The explanation of the routine B is omitted herein but will be described below in detail.

If the freezing temperature $T_F$ is below the freezing reference temperature $T_{FR}$ or the refrigerating temperature $T_R$ is below the refrigerating reference temperature $T_{RR}$, step 352 proceeds onto the routine C as shown in FIG. 9, which is the same as the second embodiment. The explanation of the routine C is omitted herein but will be described below in detail.

As described above, according to the fourth control of the initial operation mode, if the open air temperature is over the reference one, under the abnormal condition of the freezing and refrigerating compartments the refrigerating compartment is first cooled, and the freezing compartment is cooled when the refrigerating temperature becomes below the refrigerating set one. Therefore, it enables the freezing and refrigerating compartments to be maintained at the constant temperature. Thereafter, when the open air temperature is below the reference one, it is determined whether the temperature of each compartment is below the reference temperature. If the temperature of each compartment is below the reference one, the freezing and refrigerating compartments all are cooled from the first to reach their set temperatures. If the temperature of each compartment is over the reference one, any one of the freezing and refrigerating compartments is first cooled, so that both compartments can be quickly cooled to arrive at their set temperatures.

On the other hand, the normal operation modes according to the invention are as follows:

FIRST EMBODIMENT

Figure 7:
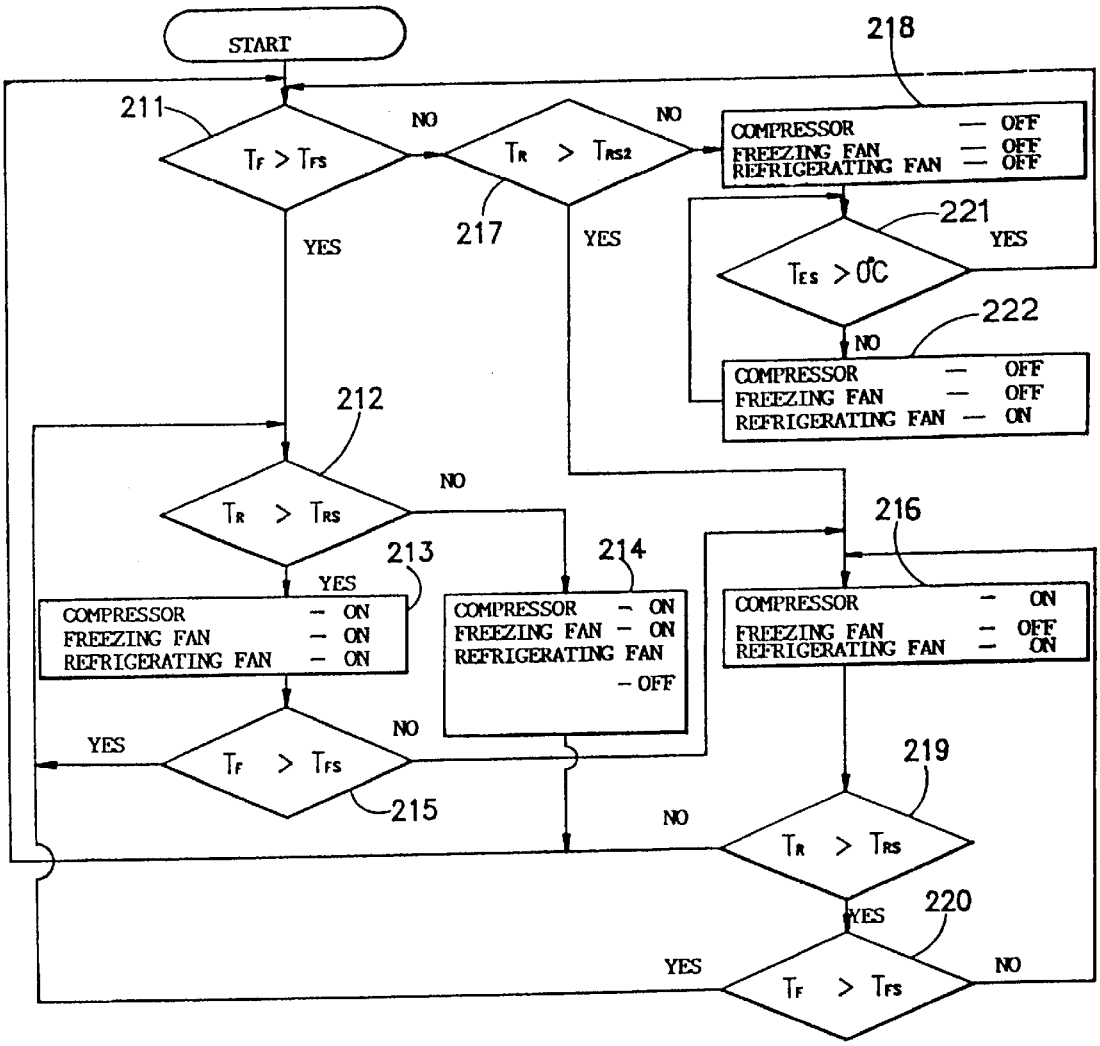
FIG. 7 is a flow chart illustrating a first embodiment of a control method of the refrigerating having H.M. cycle according to the invention.
Figures 8A, 8B, 8C:
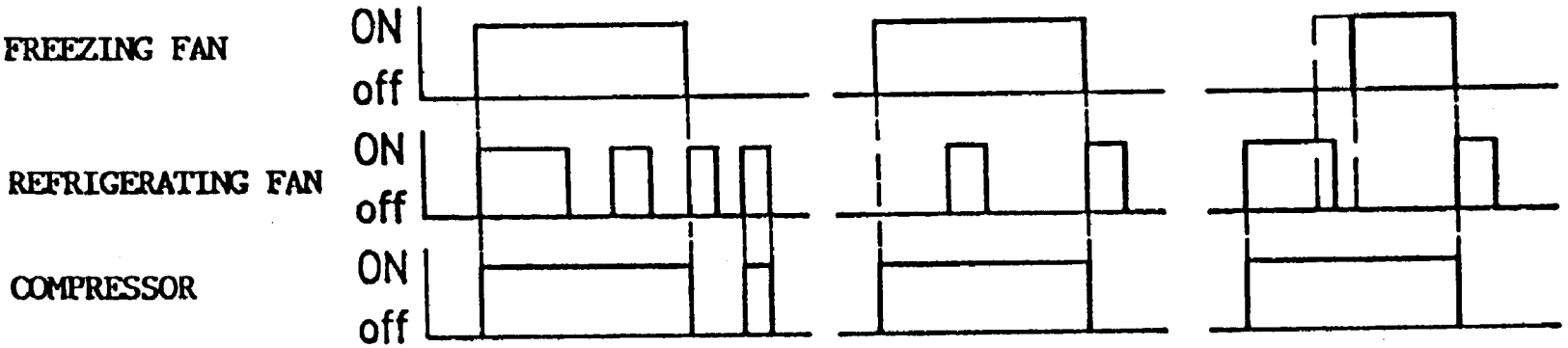
FIG. 8 is a timing diagram illustrating the operating of a compressor, a refrigerating compartment fan and a freezing compartment fan according to the first embodiment of the invention.

Referring to FIGS. 7 and 8, the control portion 35 compares the temperature $T_F$ of the freezing compartment with the freezing set one $T_{FS}$ at step 211. If the freezing temperature $T_F$ is higher than the freezing set one $T_{FS}$, step 211 goes onto step 212 to compare the refrigerating temperature $T_R$ of the refrigerating compartment with the refrigerating set one $T_{RS}$. If the refrigerating temperature $T_R$ is over the refrigerating set one $T_{RS}$, control proceeds onto step 213 to turn on the compressor and the freezing and refrigerating fans. It means the use of the freezing and refrigerating compartments subject to the high temperature state as one does not desire, but as shown in FIG. 8A both compartments are cooled, simultaneously, to take an advantage on the improvement of their cooling speed. This situation occurs when both compartments are often used, the open air temperature out of the refrigerator is higher, or the refrigerator is restated after the non-use for a long time period.

If the refrigerating temperature $T_R$ is below the refrigerating set one $T_{RS}$ at step 212, control proceeds onto step 214 to turn on the compressor and the freezing fan and turn off the refrigerating fan. Then, step 214 returns onto step 212. In that case, the freezing compartment is kept under the normal condition, and the refrigerating compartment is not maintained under the normal condition. Therefore, as shown in FIG. 8B, the compressor and the freezing fan are first operated, and then the refrigerating fan is operated when the temperature of the refrigerating compartment is over the refrigerating set one during the cooling of the freezing compartment. Step 213 goes onto step 215 to compare the freezing temperature $T_F$ with the freezing set one $T_{FS}$. If the freezing temperature $T_F$ is over the freezing set one $T_{FS}$, step 215 returns to step 212. If the freezing temperature $T_F$ is below the freezing set one $T_{FS}$, step 215 goes onto step 216 to turn on the compressor and the refrigerating fan and turn off the freezing fan. It means that during the performing of step 213, if the refrigerating temperature becomes below the refrigerating set one, the cooling of the refrigerating compartment is stopped. Also, if the freezing temperature becomes below the freezing set one, the cooling of the freezing compartment is stopped. As the refrigerating compartment is used to being first cooled, step 214 is performed to stop the cooling of the refrigerating compartment as shown in FIG. 8A.

If the freezing temperature $T_F$ is below the freezing set one $T_{FS}$ at step 211, control proceeds onto step 217 to compare the refrigerating temperature $T_R$ with a second refrigerating set one $T_{RS2}$ which is higher than the refrigerating temperature $T_{RS}$ by the predetermined temperature of 1° C. to 5° C. If the refrigerating temperature $T_R$ is over the second refrigerating set one $T_{RS2}$, control performs step 216 to turn on the compressor and the refrigerating fans and turn off the freezing fan. If the refrigerating temperature $T_R$ is below the second refrigerating set one $T_{RS2}$ at step 217, step 217 goes onto step 218 to stop the operation of the compressor and the freezing and refrigerating fans. At step 216, the freezing compartment is kept under the normal condition, and the refrigerating compartment is under the abnormal condition of the high temperature. Therefore, as shown in FIG. 8C, the compressor and the refrigerating fan are first operated under the condition that the freezing compartment is cooled according to its current state. In other words, after the refrigerating compartment is cooled below the set temperature, the freezing compartment can be cooled. Otherwise, even before the refrigerating compartment becomes cooled below the set temperature, the freezing compartment can be cooled along with the refrigerating compartment, if the freezing compartment has the temperature higher than the freezing set one.

Step 216 goes onto step 219 to compare the refrigerating temperature $T_R$ with the refrigerating set one $T_{RS}$. If the refrigerating temperature $T_R$ is below the refrigerating set one $T_{RS}$, step 216 returns to step 211. If the refrigerating temperature $T_R$ is over the refrigerating set one $T_{RS}$, step 216 goes onto step 220 to compare the freezing temperature $T_F$ with the freezing set one $T_{FS}$. If the freezing temperature $T_F$ is over the freezing set one $T_{FS}$, step 220 returns to step 212. If the freezing temperature $T_F$ is below the freezing set one $T_{FS}$, control performs step 216 to turn on the compressor and the refrigerating fan and turn off the freezing fan.

Step 218 goes onto step 221 to determine whether a first surface temperature $T_{ES}$ of the first evaporator is over 0° C., If the first surface temperature $T_{ES}$ is below 0° C., step 221 goes onto step 222 to turn off the compressor and the freezing fan and turn on the refrigerating fan as well as to perform the defrosting of the first evaporator. In other words, the operating of the refrigerating fan removes the frost on the first evaporator directly after the compressor is turned off, as the freezing and refrigerating compartments become the normal condition. It means the use of the fact that the refrigerating temperature is over that of the first evaporator during the non-operating of the compressor. As shown in FIGS. 8A, 8B and 8C, as soon as the compressor is turned off, only the refrigerating fan is operated so that the refrigerating air having the relative higher temperature is passed through the first evaporator to remove the frost thereon as well as to cool the refrigerating compartment. Therefore, an electrical separate heater for consuming the power is not only omitted, but also the over-temperature rising can be prevented.

As described above, according to the first embodiment of the invention, both of the freezing and refrigerating compartments subject to the abnormal condition are cooled together, thereby improving the cooling speed of both compartments(referring to FIG. 8A). Also, referring to FIGS. 8B and 8C, if the freezing compartment is under the abnormal condition and the refrigerating compartment is under the normal condition, the cooling of the freezing compartment is first performed. On the contrary, if the refrigerating compartment is under the abnormal condition and the freezing compartment is under the normal condition, the cooling of the refrigerating compartment is first performed. It means that during the cooling of the freezing compartment the refrigerating compartment is kept below the refrigerating set temperature. On the contrary, during the cooling of the refrigerating compartment the freezing compartment is maintained below the set temperature. Also, as soon as the compressor is turned off, only the defrosting on the first evaporator is performed, using air in the refrigerating compartment.

SECOND EMBODIMENT

Figure 10A:
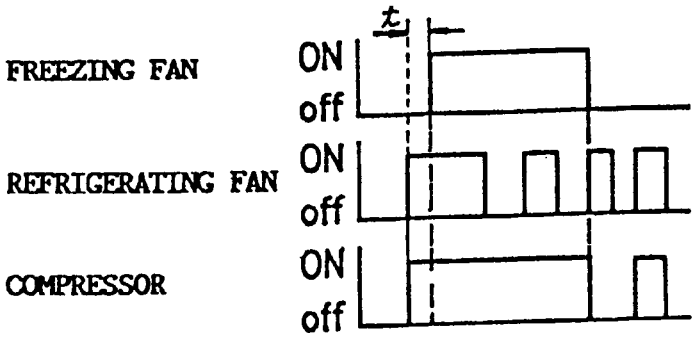
FIG. 10 is a timing diagram illustrating the operating of a compressor, a refrigerating compartment fan and a freezing compartment fan according to the second embodiment of the invention.
Figure 10B:
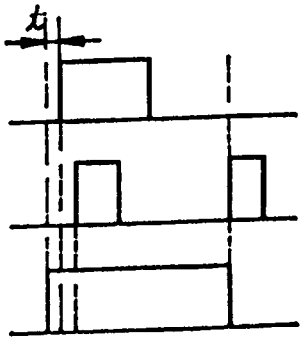

Referring to FIGS. 9 and 10, the control portion 35 compares the temperature $T_F$ of the freezing compartment with the freezing set one $T_{FS}$ at step 231. If the freezing temperature $T_F$ is over the freezing set one $T_{FS}$, step 231 goes onto step 232 to compare the refrigerating temperature $T_R$ of the refrigerating compartment with the refrigerating set one $T_{RS}$. If the refrigerating temperature $T_R$ is over the refrigerating set one $T_{RS}$, step 232 goes onto 233 to compare the freezing temperature $T_F$ and the surface temperature $T_{FE}$ of a second evaporator. If the freezing temperature $T_F$ is over the surface one $T_{FE}$ of the second evaporator(it is desirous if the freezing temperature $T_F$ is higher than the surface one $T_{FE}$ of the second evaporator by the temperature of 1° C. to 5° C., especially 2° C.). Control proceeds onto step 234 to turn on the compressor and the freezing and refrigerating fans. On the contrary, if the freezing temperature $T_F$ is below the surface one $T_{FE}$ of the second evaporator, control proceeds onto step 235 to turn on the compressor and the refrigerating fan and turn off the freezing fan. In other words, if the freezing and refrigerating compartments are subject to the abnormal condition as one does not desire, step 234 is performed to increase the cooling speed of both compartments. It means that when the surface temperature $T_{FE}$ of the second evaporator is over the freezing one $T_F$, as shown in FIG. 10A the freezing fan is operated after being delayed by the predetermined time t, thereby saving the power. This situation occurs when the residue refrigerant passed through the condenser and the capillary in the high temperature and pressure state is introduced into the first and second evaporators with the compressor being turned off after the normal operation, especially when the surface temperature of the second evaporator is over the freezing one. At that time, if the freezing fan is operated, it has a reverse effect that the temperature of the freezing compartment is rather increased. Due to this, the operation of the freezing fan is delayed until the surface temperature of the second evaporator becomes below the freezing one.

If the refrigerating temperature $T_R$ is below the refrigerating set one $T_{RS}$ at step 232, step 232 goes onto step 236 to compare the freezing temperature $T_F$ with the surface temperature $T_{FE}$ of the second evaporator. If the freezing temperature $T_F$ is over the surface one $T_{FE}$ of the second evaporator(it is desirous if the freezing temperature $T_F$ is higher than the surface one $T_{FE}$ of the second evaporator by the temperature of 1° C. to 5° C., especially 2° C.). Control proceeds onto step 237 to turn on the compressor and the freezing fan while to turn off the refrigerating fan. Otherwise, if the freezing temperature $T_F$ is below the surface one $T_{FE}$ of the second evaporator, control proceeds onto step 238 to turn off the freezing and refrigerating fans and turn on only the compressor. In other words, if the freezing compartment is subject to the abnormal condition, and the refrigerating compartment is under the normal condition, the freezing temperature and the surface temperature of the second evaporator are compared with each other to determine whether the freezing fan has to be operated. Thereafter, steps 237 and 238 returns to 231.

If the freezing temperature $T_F$ is over the freezing set one $T_{FS}$, step 231 goes onto step 239 to compare the refrigerating temperature $T_R$ with a second refrigerating set one $T_{RS2}$ which is higher than the refrigerating set temperature $T_{RS}$ by the predetermined temperature of 1° C. to 5° C. If the refrigerating temperature $T_R$ is over the second refrigerating set one $T_{RS2}$, step 239 jumps onto 235 to turn on the compressor and the refrigerating fan and turn off the freezing fan. If the refrigerating temperature $T_R$ is below the second refrigerating set one $T_{RS2}$, step 239 jumps onto 240 to turn off the compressor and the freezing and refrigerating fans.

After performing steps 234 and 235, control proceeds to step 241 to compare the freezing temperature $T_F$ with the freezing set one $T_{FS}$. If the freezing temperature $T_F$ is over the freezing set one $T_{FS}$, step 241 returns to step 233. If the freezing temperature $T_F$ is below the freezing set one $T_{FS}$, control proceeds onto step 242 to compare the refrigerating temperature $T_R$ with the refrigerating set one $T_{RS}$. If the refrigerating temperature $T_R$ is over the refrigerating set one $T_{RS}$, step 242 returns to step 235. If the refrigerating temperature $T_R$ is below the refrigerating set one $T_{RS}$, step returns to step 240. Next, step 240 goes onto step 243 to compare the surface temperature $T_{FE}$ of the second evaporator with 0° C. If the surface temperature $T_{FE}$ of the second evaporator is below 0° C., control proceed onto step 244 to turn off the compressor and the freezing fan and turn on the refrigerating fan as well as to perform the defrosting of the first evaporator as described in the first embodiment. Then, step 244 returns to step 243. If the surface temperature $T_{FE}$ of the second evaporator is over 0° C., step 243 returns to step 231.

As described above, according to the second embodiment of the invention, if both of the freezing and refrigerating compartments are subject to the abnormal condition, these compartments are cooled together, thereby improving the cooling speed of both compartments. In particular, if the surface temperature of the second evaporator is over the freezing one, the operation of the freezing fan is delayed for the predetermined time period until the surface temperature of the second evaporator becomes below the freezing one. It prevents the reverse effect of increasing the temperature of the freezing compartment. The other acting effects are the same as those of the first embodiment.

THIRD EMBODIMENT

Referring to FIG. 11, control starts from step 251 to determine whether the freezing temperature $T_F$ is over the freezing set one $T_{FS}$, or the refrigerating temperature $T_R$ is over the refrigerating set one $T_{RS}$. If the freezing temperature $T_F$ is over the freezing set one $T_{FS}$, or the refrigerating temperature $T_R$ is over the refrigerating set one $T_{RS}$, control proceeds onto step 252 to compare the refrigerating temperature $T_R$ with the refrigerating set one $T_{RS}$. If the refrigerating temperature $T_R$ is over the refrigerating set one $T_{RS}$, step 252 goes onto step 253 to compare the freezing temperature $T_F$ with the freezing set one $T_{FS}$. If the freezing temperature $T_F$ is over the freezing set one $T_{FS}$, control proceeds onto step 254 to turn on the compressor and the freezing and refrigerating fans. If the freezing temperature $T_F$ is below the freezing set one $T_{FS}$, control proceeds onto step 255 to turn on the compressor and the refrigerating fan and turn off the freezing fan.

On the other hand, if the refrigerating temperature $T_R$ is below the refrigerating set one $T_{RS}$, step 252 jumps on step 256 to compare the freezing temperature $T_F$ with the freezing set one $T_{FS}$. If the freezing temperature $T_F$ is below the freezing set one $T_{FS}$, step 256 returns to step 251. If the freezing temperature $T_F$ is over the freezing set one $T_{FS}$, control proceeds onto step 257 to turn on the compressor and the freezing fan and turn off the refrigerating fan. In other words, even if any one the freezing and refrigerating compartments is subject to the abnormal condition, the compressor is operated, while it is determined whether the freezing fan and/or the refrigerating fan is operated. Thereafter, steps 254, 255 and 257 returns to step 251.

The third embodiment enables the compressor to be operated according to the states of both freezing and refrigerating compartments. Especially, when the refrigerating temperature is over the refrigerating set one regardless of the freezing temperature, the compressor is turned on. At that case, it means that the refrigerating compartment has been often used and the temperature has been increased after the turning-off of the compressor. Thus, in case that it is necessary for both compartments to be cooled, respectively, the second embodiment has an advantage in that each compartment is independently cooled to be maintained at the set temperature.

If the refrigerating temperature $T_R$ is below the refrigerating set one $T_{RS}$ or the freezing temperature $T_F$ is below the freezing set one $T_{FS}$ at step 251, control proceeds onto step 258 to turn off the compressor and the freezing and refrigerating fans. Step 258 goes onto step 259 to determine whether the first surface temperature $T_{ES}$ of the first evaporator is over 0° C. If the first surface temperature $T_{ES}$ is below 0° C., step 259 goes onto step 260 to turn off the compressor and the freezing fan and turn on the refrigerating fan as well as to perform the defrosting of the first evaporator. Next, step 260 returns to step 259. If the first surface temperature $T_{ES}$ is over 0° C., step 259 returns to step 251.

As described above, the third embodiment is to control each compartment, independently, thereby enabling each compartment to be maintained at the set temperature.

FOURTH EMBODIMENT

Figure 12:
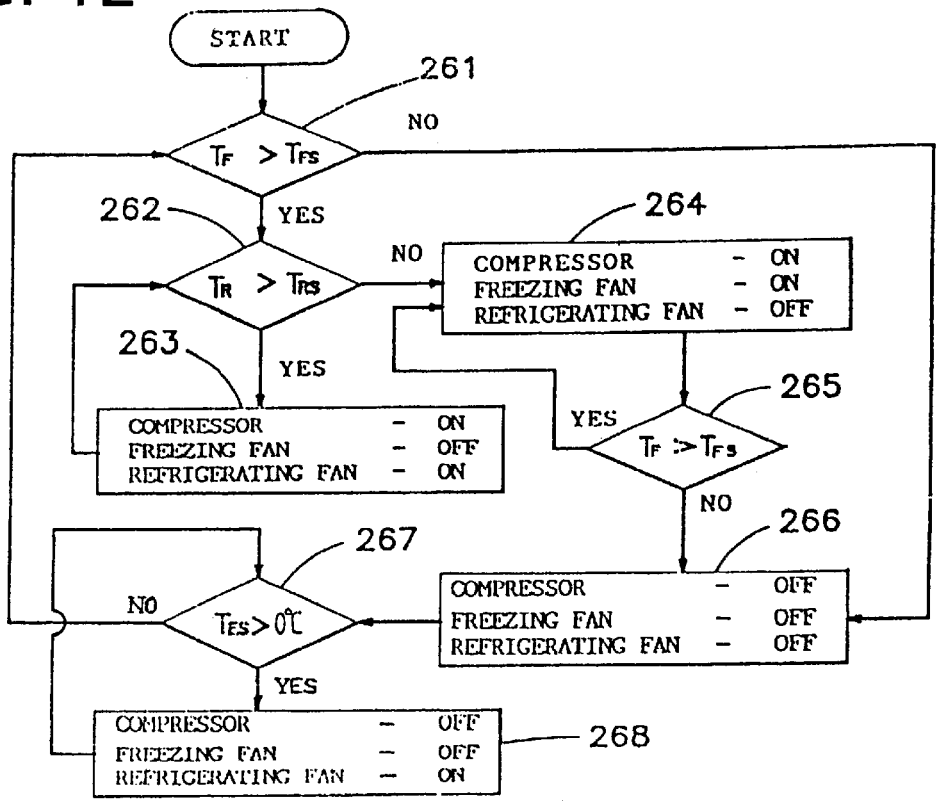
FIG. 12 is a flow chart illustrating a fourth embodiment of a control method of the refrigerating having H.M. cycle according to the invention.
Figure 13A:
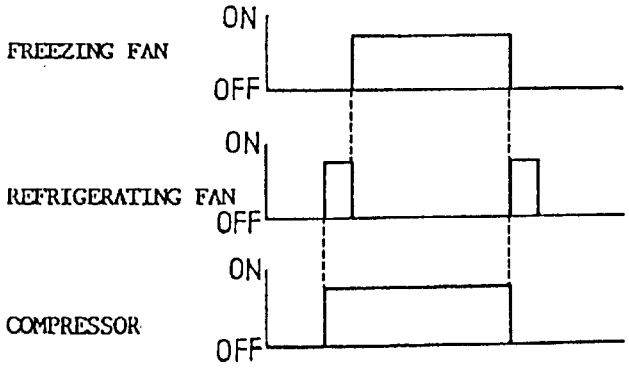
FIG. 13 is a timing diagram illustrating the operating of a compressor, a refrigerating compartment fan and a freezing compartment fan according to the fourth embodiment of the invention.

Referring to FIGS. 12 and 13, it is determined at step 261 whether the freezing temperature $T_F$ is over the freezing set one $T_{FS}$. If the freezing temperature $T_F$ is over the freezing set one $T_{FS}$, control proceeds onto step 262 to compare the refrigerating temperature $T_R$ with the refrigerating set one $T_{RS}$. If the refrigerating temperature $T_R$ is over the refrigerating set one $T_{RS}$, control proceeds onto step 263 to turn on the compressor and the refrigerating fan and turn off the freezing fan. If the refrigerating temperature $T_R$ is below the refrigerating set one $T_{RS}$, control proceeds onto step 264 to turn on the compressor and the freezing fan and turn off the refrigerating fan. In other words, the fourth embodiment has a feature in cooling the refrigerating compartment ahead of the freezing compartment, when all compartments are under the abnormal condition. At that time, the temperature of the second evaporator is higher than the refrigerating one, the temperature of the first evaporator is lower than the refrigerating one, or the difference between the temperatures of the first evaporator and the refrigerating compartment is smaller than that between the temperatures of the second evaporator and the freezing compartment. So, as shown in FIG. 13A, after the refrigerating is first cooled and then the temperature of the second evaporator is sufficiently dropped down, the freezing fan is operated to cool the freezing compartment. Therefore, nevertheless the freezing temperature is lower than that of the second evaporator, it can reduce the bad effect caused by the operation of the freezing fan and the power consumption. In other words, when the compressor is turned on according to the freezing temperature, the temperature of the second evaporator is over the freezing one and the temperature of the first evaporator is kept at below the freezing one. At that time, if the freezing fan is operated, since the temperature of the second evaporator is over the freezing one, the temperature of the freezing compartment is rather increased, thereby consuming the unnecessary energy. Thus, the refrigerating fan is first operated, because the temperature of the first evaporator is lower than the refrigerating one. It means the reduction of the energy consumption.

Figure 13B:
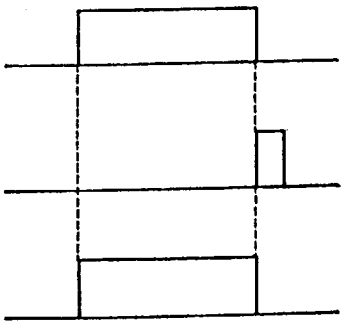

On the other hand, step 263 returns to step 262. If the refrigerating temperature $T_R$ is below the refrigerating set one $T_{RS}$, control proceeds onto step 264 to compare the freezing temperature $T_F$ with the freezing set one $T_{FS}$. In other words, if the freezing compartment is under the abnormal condition and the refrigerating compartment is under the normal condition from the first, the compressor and the freezing fan are operated, while the refrigerating fan is turned off as shown in FIG. 13B. But, if the refrigerating compartment is converted into the normal condition by being cooled under the abnormal condition of the freezing and refrigerating compartments, control performs step 264 to turn on the compressor and the freezing fan are operated and turn off the refrigerating fan. Also, the situation as shown in FIG. 13B may happen when the freezing temperature is relatively raised faster than the refrigerating one or the freezing compartment is often used, if the temperature of open air is relatively lower, for example below 10° C., or below the normal temperature.

Next, control proceeds onto step 265 to compare the freezing temperature $T_F$ with the freezing set one $T_{FS}$. If the freezing temperature $T_F$ is over the freezing set one $T_{FS}$, control proceeds onto step 264 to turn on the compressor and the freezing and refrigerating fans. If the freezing temperature $T_F$ is below the freezing set one $T_{FS}$, control proceeds onto step 266 to turn off the compressor and the freezing and refrigerating fans. Also, if the freezing temperature $T_F$ is below the freezing set one $T_{FS}$, control performs step 266.

Step 266 goes onto step 267 to determine whether the first surface temperature $T_{ES}$ of the first evaporator is over 0° C. If the first surface temperature $T_{ES}$ is below 0° C., control goes onto step 268 to turn off the compressor and the freezing fan and turn on the refrigerating fan as well as to perform the defrosting of the first evaporator. On the contrary, if the first surface temperature $T_{ES}$ is over 0° C., step 267 returns to step 261.

As described above, under the abnormal condition of the freezing and refrigerating compartments, the fourth embodiment enables the refrigerating compartment to first be cooled and then the freezing compartment to be cooled when the refrigerating temperature becomes below the refrigerating set one. It induces the efficient use of the energy. The operation of any one of the freezing and refrigerating fans reduces the peak pressure of the compressor to enhance the efficiency of the compressor.

FIFTH EMBODIMENT

Referring to FIGS. 14 and 15, it is determined at step 271 whether the freezing temperature $T_F$ is over the freezing set one $T_{FS}$. If the freezing temperature $T_F$ is over the freezing set one $T_{FS}$, control proceeds onto step 272 to compare the refrigerating temperature $T_R$ with the refrigerating set one $T_{RS}$. If the refrigerating temperature $T_R$ is over the refrigerating set one $T_{RS}$, control proceeds onto step 273 to turn on the compressor and the refrigerating fan and turn off the freezing fan. If the refrigerating temperature $T_R$ is below the refrigerating set one $T_{RS}$, control proceeds onto step 267 to turn on the compressor and the freezing fan and turn off the refrigerating fan.

Figures 15A, 15B:
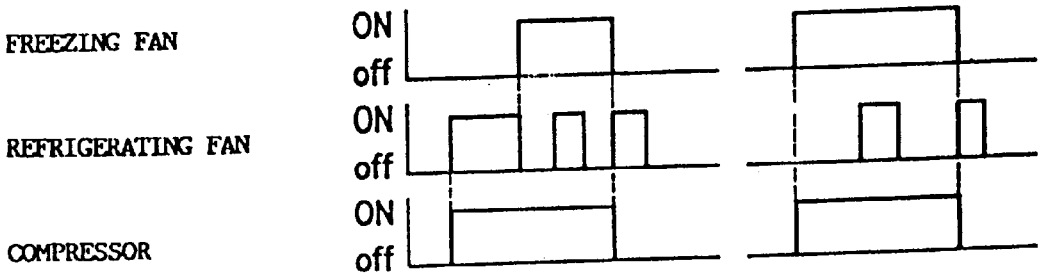
FIG. 15 is a timing diagram illustrating the operating of a compressor, a refrigerating compartment fan and a freezing compartment fan according to the fifth embodiment of the invention.

If the refrigerating temperature $T_R$ is below the refrigerating freezing set one $T_{RS}$ at step 272, control proceeds onto step 274 to turn on the compressor and the freezing fan and turn off the refrigerating fan. In other words, if the freezing compartment is under the abnormal condition and the refrigerating compartment is under the normal condition from the first, the compressor and the freezing fan are operated, while the refrigerating fan is turned off as shown in FIG. 15B. But, if the refrigerating compartment is converted into the normal condition by being cooled under the abnormal condition of the freezing and refrigerating compartments, control performs step 274 to turn on the compressor and the freezing fan and turn off the refrigerating fan as shown in FIG. 15A. Step 274 goes onto step 275 to compare the refrigerating temperature $T_R$ with the refrigerating set one $T_{RS}$. If the refrigerating temperature $T_R$ is over the refrigerating set one $T_{RS}$, step 275 goes onto step 276 to turn on the compressor and the freezing and refrigerating fans. Then, it is determined at step 277 whether the refrigerating temperature $T_R$ is over the refrigerating set one $T_{RS}$. If the refrigerating temperature $T_R$ is below the refrigerating set one $T_{RS}$, control proceeds onto step 279 to turn on the compressor and the freezing fan and turn off the refrigerating fan. If the refrigerating temperature $T_R$ is over the refrigerating set one $T_{RS}$ at step 277, step 277 goes onto step 278 to compare the freezing temperature $T_F$ with the freezing set one $T_{FS}$. If the freezing temperature $T_F$ is over the freezing set one $T_{FS}$, step 278 returns to step 276 to turn on the compressor and the freezing and refrigerating fans. If the freezing temperature $T_F$ is below the freezing set one $T_{FS}$, step 278 goes onto step 280 to turn off the compressor and the freezing and refrigerating fans. On the other hand, step 279 goes onto step 281 to compare the freezing temperature $T_F$ with the freezing set one $T_{FS}$. If the freezing temperature $T_F$ is over the freezing set one $T_{FS}$, step 281 returns to step 279. If the freezing temperature $T_F$ is below the freezing set one $T_{FS}$, step 281 goes onto step 280 to turn off the compressor and the freezing and refrigerating fans.

Also, if the refrigerating temperature $T_R$ is below the refrigerating set one $T_{RS}$, step 275 proceeds onto step 282 to compare the freezing temperature $T_F$ with the freezing set one $T_{FS}$. If the freezing temperature $T_F$ is over the freezing set one $T_{FS}$, step 282 returns to step 274. If the freezing temperature $T_F$ is below the freezing set one $T_{FS}$, control proceeds onto step 280 to turn off the compressor and the freezing and refrigerating fans. Similarly, If the freezing temperature $T_F$ is below the freezing set one $T_{FS}$ at step 271, control jumps onto step 280 to turn off the compressor and the freezing and refrigerating fans.

As described above, under the abnormal condition of the freezing and refrigerating compartments, the fifth embodiment enables the refrigerating compartment to first be cooled and then the freezing compartment to be cooled when the refrigerating temperature becomes below the refrigerating set one or is under the normal condition from the first like the fourth embodiment. Therefore, the fifth embodiment enables the freezing and refrigerating compartments to be cooled at the constant temperature, because the freezing compartment is cooled together with the refrigerating compartment when the refrigerating temperature becomes higher than the refrigerating set one during the cooling of the freezing compartment. It means that this embodiment has another advantages with those of the fourth embodiment.

On the other hand, step 280 goes onto step 283 to determine whether the first surface temperature $T_{ES}$ of the first evaporator is over 0° C. If the first surface temperature $T_{ES}$ is below 0° C., control goes onto step 284 to turn off the compressor and the freezing fan and turn on the refrigerating fan as well as to perform the defrosting of the first evaporator like another embodiments.

SIXTH EMBODIMENT

Figure 17:
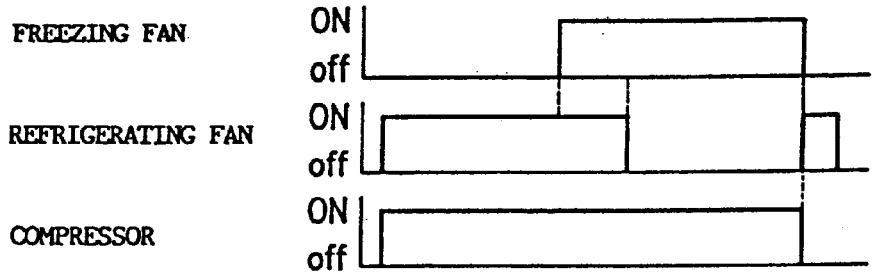
FIG. 17 is a timing diagram illustrating the operating of a compressor, a refrigerating compartment fan and a freezing compartment fan according to the sixth embodiment of the invention.

Referring to FIGS. 16 and 17, it is determined at step 291 whether the freezing temperature $T_F$ is over the freezing set one $T_{FS}$. If the freezing temperature $T_F$ is over the freezing set one $T_{FS}$, control proceeds onto step 292 to compare the refrigerating temperature $T_R$ with the second refrigerating set one $T_{RS2}$ which is higher than the refrigerating temperature $T_{RS}$ by the predetermined temperature. If the refrigerating temperature $T_R$ is over the second refrigerating set one $T_{RS2}$, step 292 goes on step 293 to turn on the compressor and the refrigerating fan and turn off the freezing fan. If the refrigerating temperature $T_R$ is below the second refrigerating set one $T_{RS2}$, step 292 goes onto step 294 to turn on the compressor and the freezing and refrigerating fans.

In other words, if the freezing compartment is under the abnormal condition as a result of detecting the freezing temperature, the refrigerating compartment is first cooled regardless of its current state. Thereafter, if the refrigerating temperature reaches the second refrigerating set one higher than the refrigerating set one by the predetermined temperature, the freezing compartment starts being cooled. It prevents the cooling delay of the freezing compartment due to the cooling delay of the refrigerating compartment. At that time, it is desirous that the second refrigerating set temperature is higher than the refrigerating set one by 1° C. to 5° C., especially 2° C. Therefore, even before the refrigerating temperature reaches the refrigerating set one, the freezing compartment is cooled, thereby improving the cooling speed of both compartments. It is possible to occur this situation at the start of the operation.

After performing step 294, control proceeds onto step 295 to compare the refrigerating temperature $T_R$ with the refrigerating set one $T_{RS}$. If the refrigerating temperature $T_R$ is over the refrigerating set one $T_{RS}$, step 295 goes onto step 296 to compare the freezing temperature $T_F$ with the freezing set one $T_{FS}$. But, if the refrigerating temperature $T_R$ is below the refrigerating set one $T_{RS}$ at step 295, control proceeds onto step 297 to turn on the compressor and the freezing fan and turn off the refrigerating fan. If the freezing temperature $T_F$ is over the freezing set one $T_{FS}$ at step 296, step 296 returns to step 294 to turn on the compressor and the freezing and refrigerating fans. If the freezing temperature $T_F$ is below the freezing set one $T_{FS}$, step 296 goes onto step 298 to turn off the compressor and the freezing and refrigerating fans. On the other hand, step 297 goes onto step 299 to compare the freezing temperature $T_F$ with the freezing set one $T_{FS}$. If the freezing temperature $T_F$ is over the freezing set one $T_{FS}$, step 299 returns to step 295. If the freezing temperature $T_F$ is below the freezing set one $T_{FS}$, step 299 goes onto step 298 to turn off the compressor and the freezing and refrigerating fans. Also, if the freezing temperature $T_F$ is below the freezing set one $T_{FS}$, control proceeds onto step 298 to turn off the compressor and the freezing and refrigerating fans.

On the other hand, step 298 goes onto step 300 to determine whether the first surface temperature $T_{ES}$ of the first evaporator is over 0° C. If the first surface temperature $T_{ES}$ is below 0° C., control proceeds onto step 300 to turn off the compressor and the freezing fan and turn on the refrigerating fan as well as to perform the defrosting of the first evaporator like another embodiments.

As described above, if the freezing compartment is under the abnormal condition as a result of detecting the freezing temperature, the refrigerating compartment starts being cooled regardless of its current state. Therefore, the sixth embodiment can save the energy like another embodiment and also will be expected to enhance the operation efficiency of the compressor by reducing the operation time thereof. Furthermore, when the refrigerating temperature reaches the second refrigerating set one higher than the refrigerating set temperature, the refrigerating compartment begins to be cooled, thereby increasing the cooling speed of both compartments.

SEVENTH EMBODIMENT

Figure 19A:
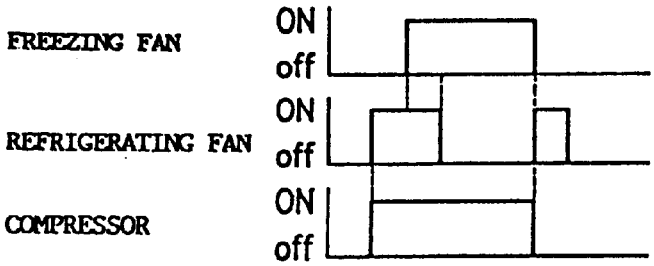
FIG. 19 is a timing diagram illustrating the operating of a compressor, a refrigerating compartment fan and a freezing compartment fan according to the seventh embodiment of the invention.
Figure 19B:
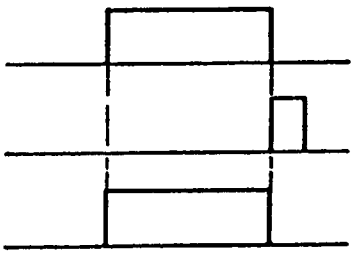
Figure 18:
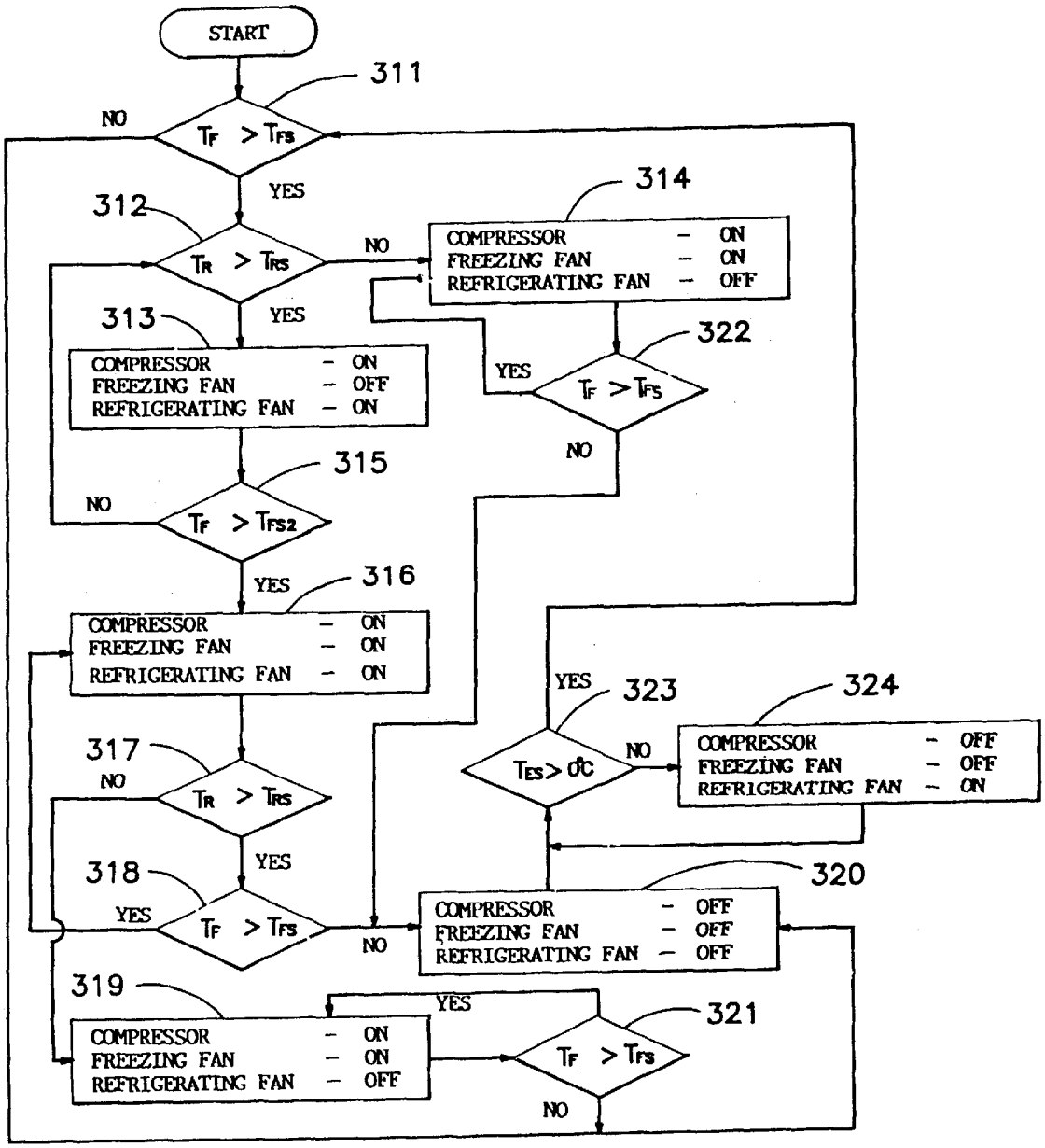
FIG. 18 is a flow chart illustrating a seventh embodiment of a control method of the refrigerating having H.M. cycle according to the invention.

Referring to FIGS. 18 and 19, it is determined at step 311 whether the freezing temperature $T_F$ is over the freezing set one $T_{FS}$. If the freezing temperature $T_F$ is over the freezing set one $T_{FS}$, control proceeds onto step 312 to compare the refrigerating temperature $T_R$ with the refrigerating set one $T_{RS}$. If the refrigerating temperature $T_R$ is over the refrigerating set one $T_{RS}$, control proceeds onto step 313 to turn on the compressor and the refrigerating fan and turn off the freezing fan. If the refrigerating temperature $T_R$ is below the refrigerating set one $T_{RS}$, control proceeds onto step 314 to turn on the compressor and the freezing fan and turn off the refrigerating fan.

Step 313 goes onto step 315 to compare the freezing temperature $T_F$ with a second freezing set one $T_{FS2}$ which is higher than the freezing temperature $T_{FS}$ by the predetermined temperature. If the freezing temperature $T_F$ is below the second freezing set one $T_{FS2}$, step 315 returns to step 312. If the freezing temperature $T_F$ is below the second freezing set one $T_{FS2}$, control proceeds onto step 316 to turn on the compressor and the freezing and refrigerating fans. In other words, as shown in FIG. 19A, under the abnormal condition of the freezing and refrigerating compartments the refrigerating compartment is first cooled. Then, in order to prevent the abrupt rising of the freezing temperature during the cooling of the refrigerating compartment the freezing fan is operated when the freezing temperature becomes the second freezing set one higher than the freezing set one. This situation occurs when the freezing is often used during the cooling of the refrigerating compartment. At that time, it is desirous that the second freezing set temperature is higher than the freezing set one by 1° C. to 5° C., especially 2° C.

Step 316 goes onto step 317 to compare the refrigerating temperature $T_R$ with the refrigerating set one $T_{RS}$. If the refrigerating temperature $T_R$ is over the refrigerating set one $T_{RS}$, step 317 goes onto step 318 to compare the freezing temperature $T_F$ with the freezing set one $T_{FS}$. But, if the refrigerating temperature $T_R$ is below the refrigerating set one $T_{RS}$ at step 317, control proceeds onto step 319 to turn on the compressor and the freezing fan and turn off the refrigerating fan. If the freezing temperature $T_F$ is over the freezing set one $T_{FS}$, step 319 returns to step 316 to turn on the compressor and the freezing and refrigerating fans. If the freezing temperature $T_F$ is below the freezing set one $T_{FS}$, step 319 returns to step 320 to turn off the compressor and the freezing and refrigerating fans.

Also, step 319 goes onto step 321 to compare the freezing temperature $T_F$ with the freezing set one $T_{FS}$. If the freezing temperature $T_F$ is over the freezing set one $T_{FS}$, step 321 returns to step 319. If the freezing temperature $T_F$ is below the freezing set one $T_{FS}$, step 321 returns to step 320 to turn off the compressor and the freezing and refrigerating fans. Also, if the freezing temperature $T_F$ is below the freezing set one $T_{FS}$ at step 311, this step jumps onto step 320 to turn off the compressor and the freezing and refrigerating fans.

On the other hand, step 314 goes onto step 322 to compare the freezing temperature $T_F$ with the freezing set one $T_{FS}$. If the freezing temperature $T_F$ is over the freezing set one $T_{FS}$, step 322 returns to step 314. If the freezing temperature $T_F$ is below the freezing set one $T_{FS}$, step 322 returns to step 320 to turn off the compressor and the freezing and refrigerating fans.

Step 320 goes onto step 323 to determine whether the first surface temperature $T_{ES}$ of the first evaporator is over 0° C. If the first surface temperature $T_{ES}$ is below 0° C., control goes onto step 324 to turn off the compressor and the freezing fan and turn on the refrigerating fan as well as to perform the defrosting of the first evaporator, which is the same to another embodiment as described above.

As described above, under the abnormal condition of the freezing and refrigerating compartments the refrigerating compartment is first cooled and then the freezing compartment is cooled even during the cooling of the refrigerating compartment, when the freezing temperature becomes the high one regardless of the cooling level of the refrigerating compartment. Therefore, it enables the freezing and refrigerating compartments to be maintained at the constant temperature. Actually, the seventh embodiment takes on the methods of first performing the cooling of the refrigerating compartment. It induces the efficient use of the energy. The operation of any one of the freezing and refrigerating fans reduces the peak pressure of the compressor to enhance the efficiency of the compressor.

EIGHT EMBODIMENT

Figure 21A:
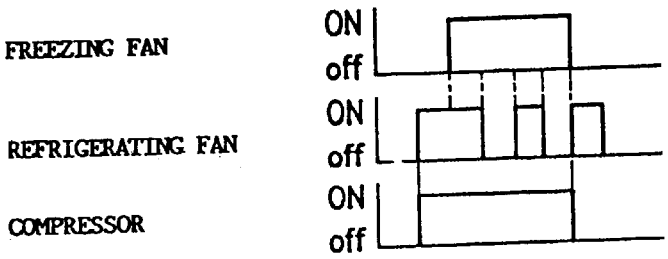
FIG. 21 is a timing diagram illustrating the operating of a compressor, a refrigerating compartment fan and a freezing compartment fan according to the eighth embodiment of the invention.
Figure 21B:
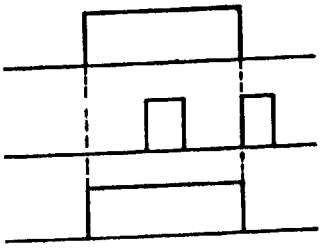

Referring to FIGS. 20 and 21, the eighth embodiment is modified from the seventh embodiment. First, control performs step 331 to compare the freezing temperature $T_F$ with the freezing set one $T_{FS}$. If the freezing temperature $T_F$ is over the freezing set one $T_{FS}$, control proceeds onto step 332 to compare the refrigerating temperature $T_R$ with the refrigerating set one $T_{RS}$. If the refrigerating temperature $T_R$ is over the refrigerating set one $T_{RS}$, control proceeds onto step 333 to turn on the compressor and the refrigerating fan and turn off the freezing fan. If the refrigerating temperature $T_R$ is below the refrigerating set one $T_{RS}$, control proceeds onto step 334 to turn on the compressor and the freezing fan and turn off the refrigerating fan.

Step 333 goes onto step 335 to compare the freezing temperature $T_F$ with a second freezing set one $T_{FS2}$ which is higher than the freezing temperature $T_{FS}$ by the predetermined temperature. If the freezing temperature $T_F$ is below the second freezing set one $T_{FS2}$, step 334 returns to step 332 to compare the refrigerating temperature $T_R$ with the refrigerating set one $T_{RS}$. If the freezing temperature $T_F$ is over the second freezing set one $T_{FS2}$, control proceeds onto step 336 to turn on the compressor and the freezing and refrigerating fans. In other words, as shown in FIG. 21A, under the abnormal condition of the freezing and refrigerating compartments the refrigerating compartment is first cooled. Then, in order to prevent the abrupt rising of the freezing temperature during the cooling of the refrigerating compartment the freezing fan is operated when the freezing temperature becomes the second freezing set one higher than the freezing set one. This situation occurs when the freezing is often used during the cooling of the refrigerating compartment. At that time, it is desirous that the second freezing set temperature is higher than the freezing set one by 1° C. to 5° C., especially 2° C.

Step 336 goes onto step 337 to compare the refrigerating temperature $T_R$ with the refrigerating set one $T_{RS}$. If the refrigerating temperature $T_R$ is over the refrigerating set one $T_{RS}$, step 337 goes onto step 338 to compare the freezing temperature $T_F$ with the freezing set one $T_{FS}$. If the refrigerating temperature $T_R$ is below the refrigerating set one $T_{RS}$, control proceeds onto step 334 to turn on the compressor and the freezing fan and turn off the refrigerating fan. If the freezing temperature $T_F$ is over the freezing set one $T_{FS}$, step 338 returns to step 336 to turn on the compressor and the freezing fan and turn off the refrigerating fan. If the freezing temperature $T_F$ is below the freezing set one $T_{FS}$, step 338 returns to step 339 to turn off the compressor and the freezing and refrigerating fans.

On the other hand, step 334 jumps onto step 340 to compare the freezing temperature $T_F$ with the freezing set one $T_{FS}$. If the freezing temperature $T_F$ is over the freezing set one $T_{FS}$, step 340 goes onto step 341 to compare the refrigerating temperature $T_R$ with the refrigerating set one $T_{RS}$. If the refrigerating temperature $T_R$ is below the refrigerating set one $T_{RS}$, control performs step 339 to turn off the compressor and the freezing and refrigerating fans. If the refrigerating temperature $T_R$ is over the refrigerating set one $T_{RS}$ at step 341, step 336 is performed. If the refrigerating temperature $T_R$ is below the refrigerating set one $T_{RS}$ at step 341, step 334 is performed. If the freezing temperature $T_F$ is below the freezing set one $T_{FS}$ step 331, step 39 is performed to turn off the compressor and the freezing and refrigerating fans.

Step 339 goes onto step 342 to compare the first surface temperature $T_{ES}$ of the first evaporator with 0° C. If the first surface temperature $T_{ES}$ is below 0° C., control proceeds onto step 324 to turn off the compressor and the freezing fan and turn on the refrigerating fan as well as to perform the defrosting of the first evaporator, which is the same to another embodiment as described above.

As described above, under the abnormal condition of the freezing and refrigerating compartments the refrigerating compartment is first cooled, and then the freezing compartment is cooled even during the cooling of the refrigerating compartment, when the freezing temperature becomes the high one regardless of the cooling level of the refrigerating compartment. Therefore, it enables the freezing and refrigerating compartments to be maintained at the constant temperature. Actually, the seventh embodiment takes on the methods of first performing the cooling of the refrigerating compartment. It induces the efficient use of the energy. The operation of any one of the freezing and refrigerating fans reduces the peak pressure of the compressor to enhance the efficiency of the compressor.

Accordingly, a refrigerator of the invention comprises independent divided freezing and refrigerating compartments, each of which is provided with an evaporator and an air circulation fan to respectively be controlled, so that the temperature difference between the compartment and its evaporator is reduced, thereby decreasing the thermal dynamic non-reversible loss according to the system control and enhancing the energy efficiency.

Also, cooled air in the refrigerating compartment can not circulated into the freezing compartment, so that an amount of the frost deposited on a second evaporator is reduced, thereby improving the heat transferring efficiency of the second evaporator, and the defrosting of a first evaporator is performed using the refrigerating air of a relatively higher temperature during the turning-off of a compressor, and then the melted moisture is circulated to form the high humidity environment in the refrigerating compartment, thereby enabling the fresh food storage for a long time period.

Also, the invention comprises independent divided freezing and refrigerating compartments provided with a cooling system to control each compartment, thereby improving the cooling speed of each compartment.

Also, the invention comprises independent divided freezing and refrigerating compartments provided with a cooling system to control each compartment, independently, thereby improving the air circulating speed, as well as to detect the temperature, minutely, by means of a sensor installed in each compartment, thereby responding to the temperature rising, quickly.

Also, the invention comprises completely separated freezing and refrigerating compartments to prevent odors emitted from stored foodstuffs such as pickled vegetables from being circulated into each other.

Also, the invention comprises a cooling system provided with two evaporators arranged in series to each other and two fans, thereby simplifying the configuration of the refrigerating cycle and enables single refrigerant to be used, thereby improving the mass-production.

What is claimed is:

1. A refrigerator having a refrigerating H.M. cycle, comprising:

a refrigerating compartment;

a freezing compartment separated from the refrigerating compartment;

a compressor for compressing refrigerant;

a condenser for condensing refrigerant;

a capillary tube for expanding refrigerant;

a first evaporator mounted in the refrigerating compartment;

a second evaporator mounted in series with the first evaporator and disposed in the freezing compartment;

a first fan mounted in the refrigerating compartment to circulate air therein from the first evaporator;

a second fan mounted in the freezing compartment to circulate air therein from the second evaporator;

an open air temperature sensor for sensing a temperature of open air surrounding the refrigerator; and a control portion for comparing an open air temperature sensed by the temperature sensor with an open air reference temperature and determining whether an overload condition of the refrigerator exists, for activating the compressor and the first and second fans to simultaneously cool both of the refrigerating and freezing compartments if no overload state exists, and for activating the compressor and the first fan prior to activating the second fan if an overload state exists, whereby the second fan is activated after the refrigerating compartment is cooled if an overload state exists.

2. The refrigerator as claimed in claim 1, in which:

the refrigerator further comprises a first surface temperature sensor for detecting a surface temperature of the first evaporator and a second surface temperature sensor for detecting a surface temperature of the second evaporator; and the control portion is electrically connected to the first and second sensors for turning on the first fan and turning off the compressor and the second fan to perform a defrosting of the first evaporator, when the temperature of the refrigerating compartment is over the surface temperature of the first evaporator during a non-operating state of the compressor.

3. A control method of a refrigerator having freezing and refrigerating compartments and a refrigerating H.M. cycle comprising steps of:

comparing the freezing temperature with the freezing set one appropriate for storing foodstuffs in the freezing compartment at step 211;

comparing the refrigerating temperature with the refrigerating set one appropriate for storing foodstuffs in the refrigerating compartment at step 212;

operating the compressor and the freezing and refrigerating fans at step 213 to cool both refrigerating and freezing compartments, if the refrigerating and freezing temperatures are over their set ones at steps 212 and 213;

turning on the compressor and the freezing fan and turning off the refrigerating fan at step 214, if the refrigerating temperature is below the refrigerating set one at step 212, and then, performing step 212;

comparing the refrigerating temperature with a second refrigerating set one which is higher than the refrigerating temperature by the predetermined temperature at step 217, if the freezing temperature is below the freezing set one at step 211; and performing step 216 to turn on the compressor and the refrigerating fan and turn off the freezing fan, if the refrigerating temperature is over the second refrigerating set one.

4. The control method as claimed in claim 3, furthermore comprising steps of:

comparing the freezing temperature with the freezing set one at step 215 after performing step 213 to turn on the compressor and the refrigerating and freezing fans;

performing step 212, again, if the freezing temperature is over the freezing set one at step 215; and turning on the compressor and the refrigerating fan and turning off the freezing fan at step 216, if the freezing temperature is below the freezing set one at step 215.

5. The control method as claimed in claim 4, furthermore comprising steps of:

comparing the refrigerating temperature with the refrigerating set one at step 219 after performing step 216;

performing step 211, if the refrigerating temperature is below the refrigerating set one at step 219;

comparing the freezing temperature with the freezing set one at step 220, if the refrigerating temperature is over the refrigerating set one;

performing step 212, if the freezing temperature is over the freezing set one at step 220; and performing step 216 to turn on the compressor and the refrigerating fan and turn off the freezing fan, if the freezing temperature is below the freezing set one.

6. The control method as claimed in claim 3, furthermore comprising steps of:

turning off the compressor and the freezing and refrigerating fans at step 218, if the refrigerating temperature is below the second refrigerating set one at step 217.

7. The control method as claimed in claim 6, in which:

the second refrigerating set one is higher than the refrigerating temperature by 1° C. to 5° C.

8. The control method as claimed in claim 6, furthermore comprising steps of:

comparing a first surface temperature of the first evaporator with 0° C. at step 221, after performing step 218; and turning off the compressor and the freezing fan and turning on the refrigerating fan at step 222, if the first surface temperature is below 0° C.

9. The control method as claimed in claim 6, in which:

the freezing set temperature is −15° C. to −21° C., and the refrigerating temperature is −1° C. to 6° C.

10. A control method of a refrigerator having freezing and refrigerating compartments and a refrigerating H. M. cycle comprising steps of:

a) comparing an open air temperature with an open air one previously set by the reference of determining whether the open air is regarded as an overload condition of a refrigerator;

b) turning on a compressor and freezing and refrigerating fans, if the open air temperature is over the open air set one at step a;

c) comparing a freezing temperature with a freezing reference one set to cool the freezing compartment in a normal state, even if the freezing reference temperature is higher than the freezing temperature and its set one, and a refrigerating temperature with a refrigerating reference one set to cool the refrigerating compartment in a normal state, even if the refrigerating temperature is higher than the refrigerating temperature and its set one, if the open air temperature is below the open air set one;

d) turning on the compressor and the refrigerating fan, first, if the freezing temperature is over the freezing reference one and the refrigerating temperature is over the refrigerating reference temperature at step c; and e) turning on the compressor and the freezing and refrigerating fans, if the freezing temperature is below the freezing reference one and the refrigerating temperature is below the refrigerating reference temperature.

11. The control method as claimed in claim 10, in which the routine c furthermore comprises steps of:

comparing the freezing temperature with the freezing set one and the refrigerating temperature with the refrigerating set one, respectively, at steps 231 and 232;

comparing the freezing temperature with the surface second temperature at step 233 in order to delay the operating of the freezing fan for a predetermined time period, if the refrigerating and freezing temperatures are over their set ones at steps 231 and 232;

turning on the compressor and the refrigerating and freezing fans at step 234, if the freezing temperature is over the second surface one at step 233;

turning on the compressor and the refrigerating fan at step 235, if the freezing temperature is below the second surface one at step 233;

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and the freezing fan and turning off the refrigerating fan at step 237, if the freezing temperature is over the second surface one at step 236; and turning on the compressor and turning off the refrigerating and freezing fans at step 238, if the freezing temperature is below the second surface one at step 236.

12. The control method as claimed in claim 11, furthermore comprising steps of:

comparing the freezing temperature with the freezing set one at step 241 after performing steps 234 and 235;

performing step 233 to compare the freezing temperature with the surface second temperature, if the freezing temperature is over the freezing set one at step 241;

comparing the refrigerating temperature with the refrigerating set one at step 242, if the freezing temperature is below the freezing set one;

performing step 235 if the refrigerating temperature is below the refrigerating set one at step 242; and turning off the compressor and the freezing and refrigerating fans at step 240, if the refrigerating temperature is below the refrigerating set one at step 242.

13. The control method as claimed in claim 12, furthermore comprising steps of:

comparing the second surface temperature with 0° C. at step 243, after performing step 240;

turning off the compressor and the freezing fan and turning on the refrigerating fan at step 244, if the second surface temperature is below 0° C., thereby performing the defrosting of the first evaporator.

14. The control method as claimed in claim 13, furthermore comprising steps of:

comparing the second surface temperature with 0° C. at step 243, after performing step 240;

turning off the compressor and the freezing fan and turning on the refrigerating fan at step 244, thereby performing the defrosting of the first evaporator, if the second surface temperature is below 0° C.

15. The control method as claimed in claim 14, in which:

the second refrigerating set temperature is higher than the refrigerating set one by 1° C. to 5° C.

16. The control method as claimed in claim 14, furthermore comprising steps of:

determining whether the freezing temperature is higher than the second surface refrigerating one by 1° C. to 5° C.

17. The control method as claimed in claim 11, furthermore comprising steps of:

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and turning off the refrigerating and freezing fans at step 238, if the freezing temperature is below the second surface one at step 236; and turning on the compressor and the freezing fan and turning off the refrigerating fan at step 237, if the freezing temperature is over the second surface one at step 236.

18. The control method as claimed in claim 11, in which:

the freezing set temperature is −15° C. to −21° C., and the refrigerating temperature is −1° C. to 6° C.

19. The control method as claimed in claim 11, in which:

the freezing reference temperature is −14° C. to −5° C., and the refrigerating temperature is 7° C. to 15° C.

20. The control method as claimed in claim 11, in which:

the open air reference temperature is 30° C. to 35° C.

21. The control method as claimed in claim 10, in which the routine d furthermore comprises steps of:

comparing the freezing temperature with the freezing set one at step 291;

comparing the refrigerating temperature with a second refrigerating set one which is higher that the refrigerating set temperature, at step 292, if the freezing temperature is over the freezing set one;

turning on the compressor and the refrigerating fan and turning off the freezing fan at step 293, if the refrigerating temperature is over the second refrigerating set one;

turning on the compressor and the freezing and refrigerating fans at step 294, if the refrigerating temperature is below the second refrigerating set one at step 292;

comparing the refrigerating temperature with the refrigerating set one at step 295 after performing step 294;

comparing the freezing temperature with the freezing set one at step 296, if the refrigerating temperature is over the refrigerating set one at step 295; and turning on the compressor and the freezing fan and turning off the refrigerating fan at step 297, if the refrigerating temperature is below the refrigerating set one at step 295.

22. The control method as claimed in claim 21, in which:

the second refrigerating temperature is higher that the refrigerating set one by 1° C. to 5° C.

23. The control method as claimed in claim 21, furthermore comprising steps of:

turning on the compressor and the freezing and refrigerating fans at step 294, if the freezing temperature is over the freezing set one at step 296; and turning off the compressor and the freezing and refrigerating fans at step 298, if the freezing temperature is below the freezing set one at step 296.

24. The control method as claimed in claim 21, furthermore comprising steps of:

comparing the freezing temperature with the freezing set one at step 299 during performing step 297;

comparing the refrigerating temperature with the refrigerating set one at step 295, if the freezing temperature is over the freezing set one at step 299; and turning off the compressor and the freezing and refrigerating fans at step 298, if the freezing temperature is below the freezing set one at step 299.

25. The control method as claimed in claim 21, furthermore comprising steps of:

turning off the compressor and the freezing and refrigerating fans at step 298, if the freezing temperature is below the freezing set one at step 291.

26. The control method as claimed in claim 21, furthermore comprising steps of:

comparing the first surface temperature with 0° C. at step 300 after performing step 298; and turning off the compressor and the freezing fan and turning on the refrigerating fan at step 301, thereby performing the defrosting of the first evaporator, if the first surface temperature is below 0° C.

27. The control method as claimed in claim 21, in which:

the freezing set temperature is −15° C. to −21° C., and the refrigerating temperature is −1° C. to 6° C.

28. The control method as claimed in claim 11, in which the routine e furthermore comprises steps of:

comparing the freezing temperature with the freezing set one and the refrigerating temperature with the refrigerating set one, respectively, at steps 231 and 232;

comparing the freezing temperature with the surface second temperature at step 233 in order to delay the operating of the freezing fan for a predetermined time period, if the refrigerating and freezing temperatures are over their set ones at steps 231 and 232;

turning on the compressor and the refrigerating and freezing fans at step 234, if the freezing temperature is over the second surface one at step 233;

turning on the compressor and the refrigerating fan at step 235, if the freezing temperature is below the second surface one at step 233;

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and the freezing fan and turning off the refrigerating fan at step 237, if the freezing temperature is over the second surface one at step 236; and turning on the compressor and turning off the refrigerating and freezing fans at step 238, if the freezing temperature is below the second surface one at step 236.

29. The control method as claimed in claim 28, furthermore comprising steps of:

comparing the freezing temperature with the freezing set one at step 241 after performing steps 234 and 235;

performing step 233 to compare the freezing temperature with the surface second temperature, if the freezing temperature is over the freezing set one at step 241;

comparing the refrigerating temperature with the refrigerating set one at step 242, if the freezing temperature is below the freezing set one;

performing step 235 if the refrigerating temperature is below the refrigerating set one at step 242; and turning off the compressor and the freezing and refrigerating fans at step 240, if the refrigerating temperature is below the refrigerating set one at step 242.

30. The control method as claimed in claim 28, furthermore comprising steps of:

comparing the second surface temperature with 0° C. at step 243, after performing step 240;

turning off the compressor and the freezing fan and turning on the refrigerating fan at step 244, if the second surface temperature is below 0° C., thereby performing the defrosting of the first evaporator.

31. The control method as claimed in claim 28, furthermore comprising steps of:

comparing the second surface temperature with 0° C. at step 243, after performing step 240;

turning off the compressor and the freezing fan and turning on the refrigerating fan at step 244, thereby performing the defrosting of the first evaporator, if the second surface temperature is below 0° C.

32. The control method as claimed in claim 28, in which:

the second refrigerating set temperature is higher than the refrigerating set one by 1° C. to 5° C.

33. The control method as claimed in claim 28, furthermore comprising steps of:

determining whether the freezing temperature is higher than the second surface refrigerating one by 1° C. to 5° C.

34. A control method of a refrigerator having freezing and refrigerating compartments and a refrigerating H.M. cycle comprising steps of:

a1) comparing an open air temperature with an open air one previously set by the reference of determining whether the open air is regarded as an overload condition of a refrigerator;

b1) comparing a freezing temperature with a freezing set, one which is higher than a temperature appropriate for storing foodstuff in a freezing compartment, and a refrigerating temperature with a refrigerating set one, which is higher than a temperature appropriate for storing foodstuff in a refrigerating compartment, if the open air temperature is over the open air set one at step a1;

c1) turning on a compressor, if the freezing temperature is over the freezing set one and the refrigerating temperature is over the refrigerating set one at step b1, while operating the corresponding fan in each of the refrigerating and freezing compartments, if any one of the refrigerating and freezing temperatures are over their set ones;

d1) comparing the freezing temperature with a freezing reference one set to cool the freezing chamber in a normal state and a refrigerating temperature with the refrigerating reference one set to cool the refrigerating chamber in a normal state, if the open air temperature is over the open air set one; and e1) turning on a compressor and the refrigerating fan, first, if the freezing temperature is over the freezing reference one and the refrigerating temperature is over the refrigerating reference temperature at step d1; and f1) turning on the compressor and the freezing and refrigerating fans, if the freezing temperature is below the freezing reference one and the refrigerating temperature is below the refrigerating reference temperature at step e1.

35. The control method as claimed in claim 34, in which the routine c1 comprises steps of:

turning on the compressor and the freezing and refrigerating fans at step 254 to cool the refrigerating and freezing compartments, simultaneously, if the refrigerating and freezing temperatures are over their set ones at steps 251 to 253 and 256 representing said step b; and turning on the compressor and the refrigerating fan and turning off the freezing fan at step 255, if the freezing temperature is below the freezing set one and the refrigerating temperature is over its set one at said steps; and turning on the compressor and the freezing fan and turning off the refrigerating fan at step 257, if the freezing temperature is over the freezing set one and the refrigerating temperature is below the refrigerating set one at said steps.

36. The control method as claimed in claim 35, furthermore comprising steps of:

turning off the compressor and the freezing and refrigerating fans at step 258, if the refrigerating and freezing temperatures is below their set ones at said steps.

37. The control method as claimed in claim 35, furthermore comprising steps of:

comparing a first surface temperature with 0° C. at step 259 after performing step 258;

turning off the compressor and the freezing fan and turning on the refrigerating fan at step 260, thereby performing the defrosting of the first evaporator, if the first surface temperature is below 0° C.

38. The control method as claimed in claim 35, in which:

the freezing set temperature is −15° C. to −21° C., and the refrigerating temperature is −1° C. to 6° C.

39. The control method as claimed in claim 34, in which the routine e1 furthermore comprises steps of:

comparing the freezing temperature with the freezing set one and the refrigerating temperature with the refrigerating set one, respectively, at steps 231 and 232;

comparing the freezing temperature with the surface second temperature at step 233 in order to delay the operating of the freezing fan for a predetermined time period, if the refrigerating and freezing temperatures are over their set ones at steps 231 and 232;

turning on the compressor and the refrigerating and freezing fans at step 234, if the freezing temperature is over the second surface one at step 233;

turning on the compressor and the refrigerating fan at step 235, if the freezing temperature is below the second surface one at step 233;

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and the freezing fan and turning off the refrigerating fan at step 237, if the freezing temperature is over the second surface one at step 236; and turning on the compressor and turning off the refrigerating and freezing fans at step 238, if the freezing temperature is below the second surface one at step 236.

40. The control method as claimed in claim 39, furthermore comprising steps of:

comparing the freezing temperature with the freezing set one at step 241 after performing steps 234 and 235;

performing step 233 to compare the freezing temperature with the surface second temperature, if the freezing temperature is over the freezing set one at step 241;

comparing the refrigerating temperature with the refrigerating set one at step 242, if the freezing temperature is below the freezing set one;

performing step 235 if the refrigerating temperature is below the refrigerating set one at step 242; and turning off the compressor and the freezing and refrigerating fans at step 240, if the refrigerating temperature is below the refrigerating set one at step 242.

41. The control method as claimed in claim 39, furthermore comprising steps of:

comparing the second surface temperature with 0° C. at step 243, after performing step 240;

turning off the compressor and the freezing fan and turning on the refrigerating fan at step 244, if the second surface temperature is below 0° C., thereby performing the defrosting of the first evaporator.

42. The control method as claimed in claim 39, furthermore comprising steps of:

comparing the second surface temperature with 0° C. at step 243, after performing step 240;

turning off the compressor and the freezing fan and turning on the refrigerating fan at step 244, thereby performing the defrosting of the first evaporator, if the second surface temperature is below 0° C.

43. The control method as claimed in claim 39, in which:

the second refrigerating set temperature is higher than the refrigerating set one by 1° C. to 5° C.

44. The control method as claimed in claim 39, furthermore comprising steps of:

determining whether the freezing temperature is higher than the second surface refrigerating one by 1° C. to 5° C.

45. The control method as claimed in claim 39, in which:

the open air reference temperature is 30° C. to 35° C.

46. The control method as claimed in claim 39, in which:

the freezing set temperature is −15° C. to −21° C., and the refrigerating temperature is −1° C. to 6° C.

47. The control method as claimed in claim 39, in which:

the freezing reference temperature is −14° C. to −5° C., and the refrigerating temperature is 7° C. to 15° C.

48. The control method as claimed in claim 39, furthermore comprising steps of:

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and turning off the refrigerating and freezing fans at step 238, if the freezing temperature is below the second surface one at step 236; and turning on the compressor and the freezing fan and turning off the refrigerating fan at step 237, if the freezing temperature is over the second surface one at step 236.

49. The control method as claimed in claim 34, in which the routine d1 furthermore comprises steps of:

comparing the freezing temperature with the freezing set one at step 291;

comparing the refrigerating temperature with a second refrigerating set one which is higher that the refrigerating set temperature, at step 292, if the freezing temperature is over the freezing set one;

turning on the compressor and the refrigerating fan and turning off the freezing fan at step 293, if the refrigerating temperature is over the second refrigerating set one;

turning on the compressor and the freezing and refrigerating fans at step 294, if the refrigerating temperature is below the second refrigerating set one at step 292;

comparing the refrigerating temperature with the refrigerating set one at step 295 after performing step 294;

comparing the freezing temperature with the freezing set one at step 296, if the refrigerating temperature is over the refrigerating set one at step 295; and turning on the compressor and the freezing fan and turning off the refrigerating fan at step 297, if the refrigerating temperature is below the refrigerating set one at step 295.

50. The control method as claimed in claim 49, in which:

the freezing set temperature is −15° C. to −21° C., and the refrigerating temperature is −1° C. to 6° C.

51. The control method as claimed in claim 49, in which:

the second refrigerating temperature is higher that the refrigerating set one by 1° C. to 5° C.

52. The control method as claimed in claim 49, furthermore comprising steps of:

turning on the compressor and the freezing and refrigerating fans at step 294, if the freezing temperature is over the freezing set one at step 296; and turning off the compressor and the freezing and refrigerating fans at step 298, if the freezing temperature is below the freezing set one at step 296.

53. The control method as claimed in claim 49, furthermore comprising steps of:

comparing the freezing temperature with the freezing set one at step 299 during performing step 297;

comparing the refrigerating temperature with the refrigerating set one at step 295, if the freezing temperature is over the freezing set one at step 299; and turning off the compressor and the freezing and refrigerating fans at step 298, if the freezing temperature is below the freezing set one at step 299.

54. The control method as claimed in claim 49, furthermore comprising steps of:

turning off the compressor and the freezing and refrigerating fans at step 298, if the freezing temperature is below the freezing set one at step 291.

55. The control method as claimed in claim 49, furthermore comprising steps of:

comparing the first surface temperature with 0° C. at step 300 after performing step 298; and turning off the compressor and the freezing fan and turning on the refrigerating fan at step 301, thereby performing the defrosting of the first evaporator, if the first surface temperature is below 0° C.

56. A control method of a refrigerator having freezing and refrigerating compartments and a refrigerating H. M. cycle comprising:

a2) comparing an open air temperature out of a refrigerator with an open air reference one previously set by reference of determining whether the open air state is regarded as an overload condition of a refrigerator;

b2) cooling the refrigerating compartment, first, even if the refrigerating and freezing temperatures are over their set ones, when the open air temperature is over the open air reference one and then cooling the freezing compartment, if the refrigerating temperature is below the refrigerating reference one at step a2;

c2) comparing the freezing temperature with a freezing reference one set to cool the freezing chamber in a normal state and a refrigerating temperature with the refrigerating reference one set to cool the refrigerating chamber in a normal state, even if the open air temperature is over the freezing reference one and the refrigerating temperature, when the open air temperature is below the open air set one;

d2) turning on the compressor and the refrigerating fan, first, if the freezing temperature is over the freezing reference one and the refrigerating temperature is over the refrigerating reference temperature at step c2; and e2) turning on the compressor and the freezing and refrigerating fans to cool the refrigerating and freezing compartments, if the freezing temperature is below the freezing reference one and the refrigerating temperature is below the refrigerating reference temperature at step c2.

57. The control method as claimed in claim 56, in which the routine b2 comprises steps:

comparing the freezing temperature with the freezing set one and the refrigerating temperature with the refrigerating set one, respectively, at steps 271 and 272;

turning on the compressor and the refrigerating fan and turning off the freezing fan at step 273, if the refrigerating temperature is over the refrigerating set one at step 272;

turning on the compressor and the freezing fan and turning off the refrigerating fan at step 274, if the refrigerating temperature is below the refrigerating set one at step 272;

comparing the refrigerating temperature with the refrigerating set one at step 275 after performing step 274; and turning on the compressor and the freezing and refrigerating fans, continuously, at step 276, if the refrigerating temperature is over the refrigerating set one;

comparing the refrigerating temperature with the refrigerating set one at step 277 after performing step 276; and turning on the compressor and the freezing fan and turning off the refrigerating fan at step 279, if the refrigerating temperature is below the refrigerating set one.

58. The control method as claimed in claim 57, furthermore comprising steps of:

turning off the compressor and the freezing and refrigerating fans at step 280, if the freezing temperature is below the freezing set one at step 278.

59. The control method as claimed in claim 57, furthermore comprising steps of:

comparing the freezing temperature with the freezing set one at step 282, if the refrigerating temperature is below the refrigerating set one after performing step 275;

turning on the compressor and the freezing fan and turn off the refrigerating fan at step 274, if the freezing temperature is over the freezing set one; and turning off the compressor and the freezing and refrigerating fans at step 280, if the freezing temperature is below the freezing set one.

60. The control method as claimed in claim 57, furthermore comprising steps of:

comparing the first surface temperature with 0° C. at step 283 after performing step 280; and turning off the compressor and the freezing fan and turning on the refrigerating fan at step 284, thereby performing the defrosting of the first evaporator, if the first surface temperature is below 0° C.;

comparing the refrigerating temperature with the refrigerating set one at step 277 after performing step 276;

comparing the freezing temperature with the freezing set one at step 278, if the refrigerating temperature is over the refrigerating set one;

performing step 276 to turn on the compressor and the freezing and refrigerating fans, if the freezing temperature is over the freezing set one; and turning off the compressor and the freezing and refrigerating fans at step 280, if the freezing temperature is below the freezing set one.

61. The control method as claimed in claim 56, in which the routine d2 comprises steps:

comparing the freezing temperature with the freezing set one at step 291;

comparing the refrigerating temperature with a second refrigerating set one which is higher that the refrigerating set temperature, at step 292, if the freezing temperature is over the freezing set one;

turning on the compressor and the refrigerating fan and turning off the freezing fan at step 293, if the refrigerating temperature is over the second refrigerating set one;

turning on the compressor and the freezing and refrigerating fans at step 294, if the refrigerating temperature is below the second refrigerating set one at step 292;

comparing the refrigerating temperature with the refrigerating set one at step 295 after performing step 294;

comparing the freezing temperature with the freezing set one at step 296, if the refrigerating temperature is over the refrigerating set one at step 295; and turning on the compressor and the freezing fan and turning off the refrigerating fan at step 297, if the refrigerating temperature is below the refrigerating set one at step 295.

62. The control method as claimed in claim 61, in which:

the second refrigerating temperature is higher that the refrigerating set one by 1° C. to 5° C.

63. The control method as claimed in claim 61, furthermore comprising steps of:

turning on the compressor and the freezing and refrigerating fans at step 294, if the freezing temperature is over the freezing set one at step 296; and turning off the compressor and the freezing and refrigerating fans at step 298, if the freezing temperature is below the freezing set one at step 296.

64. The control method as claimed in claim 61, furthermore comprising steps of:

comparing the freezing temperature with the freezing set one at step 299 during performing step 297;

comparing the refrigerating temperature with the refrigerating set one at step 295, if the freezing temperature is over the freezing set one at step 299; and turning off the compressor and the freezing and refrigerating fans at step 298, if the freezing temperature is below the freezing set one at step 299.

65. The control method as claimed in claim 61, furthermore comprising steps of:

turning off the compressor and the freezing and refrigerating fans at step 298, if the freezing temperature is below the freezing set one at step 291.

66. The control method as claimed in claim 61, furthermore comprising steps of:

comparing the first surface temperature with 0° C. at step 300 after performing step 298; and turning off the compressor and the freezing fan and turning on the refrigerating fan at step 301, thereby performing the defrosting of the first evaporator, if the first surface temperature is below 0° C.

67. The control method as claimed in claim 61, in which:

the freezing set temperature is −15° C. to −21° C., and the refrigerating temperature is −1° C. to 6° C.

68. The control method as claimed in claim 56, in which the routine e2 furthermore comprises steps of:

comparing the freezing temperature with the freezing set one and the refrigerating temperature with the refrigerating set one, respectively, at steps 231 and 232;

comparing the freezing temperature with the surface second temperature at step 233 in order to delay the operating of the freezing fan for a predetermined time period, if the refrigerating and freezing temperatures are over their set ones at steps 231 and 232;

turning on the compressor and the refrigerating and freezing fans at step 234, if the freezing temperature is over the second surface one at step 233;

turning on the compressor and the refrigerating fan at step 235, if the freezing temperature is below the second surface one at step 233;

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and the freezing fan and turning off the refrigerating fan at step 237, if the freezing temperature is over the second surface one at step 236; and turning on the compressor and turning off the refrigerating and freezing fans at step 238, if the freezing temperature is below the second surface one at step 236.

69. The control method as claimed in claim 68, furthermore comprising steps of:

comparing the freezing temperature with the freezing set one at step 241 after performing steps 234 and 235;

performing step 233 to compare the freezing temperature with the surface second temperature, if the freezing temperature is over the freezing set one at step 241;

comparing the refrigerating temperature with the refrigerating set one at step 242, if the freezing temperature is below the freezing set one;

performing step 235 if the refrigerating temperature is below the refrigerating set one at step 242; and turning off the compressor and the freezing and refrigerating fans at step 240, if the refrigerating temperature is below the refrigerating set one at step 242.

70. The control method as claimed in claim 68, furthermore comprising steps of:

comparing the second surface temperature with 0° C. at step 243, after performing step 240;

turning off the compressor and the freezing fan and turning on the refrigerating fan at step 244, if the second surface temperature is below 0° C., thereby performing the defrosting of the first evaporator.

71. The control method as claimed in claim 68, furthermore comprising steps of:

comparing the second surface temperature with 0° C. at step 243, after performing step 240;

turning off the compressor and the freezing fan and turning on the refrigerating fan at step 244, thereby performing the defrosting of the first evaporator, if the second surface temperature is below 0° C.

72. The control method as claimed in claim 68, in which:

the second refrigerating set temperature is higher than the refrigerating set one by 1° C. to 5° C.

73. The control method as claimed in claim 68, furthermore comprising steps of:

determining whether the freezing temperature is higher than the second surface refrigerating one by 1° C. to 5° C.

74. The control method as claimed in claim 68, in which:

the open air reference temperature is 30° C. to 35° C.

75. The control method as claimed in claim 68, in which:

the freezing set temperature is −15° C. to −21° C., and the refrigerating temperature is −1° C. to 6° C.

76. The control method as claimed in claim 72, furthermore comprising steps of:

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and turning off the refrigerating and freezing fans at step 238, if the freezing temperature is below the second surface one at step 236; and turning on the compressor and the freezing fan and turning off the refrigerating fan at step 237, if the freezing temperature is over the second surface one at step 236.

77. A control method of a refrigerator having freezing and refrigerating compartments and a refrigerating H. M. cycle comprising:

a3) comparing an open air temperature out of a refrigerator with an open air reference temperature by reference of determining whether the open air state is regarded as an overload condition of a refrigerator;

b3) cooling the refrigerating compartment, first, even if the refrigerating and freezing temperatures are over their set ones, when the open air temperature is over the open air reference one and then cooling the freezing compartment, if the freezing temperature becomes higher than the freezing reference one up to a predetermined temperature at step a3;

c3) comparing the freezing temperature with a freezing reference one set to cool the freezing chamber in a normal state and a refrigerating temperature with the refrigerating reference one set to cool the refrigerating chamber in a normal state, even if the open air temperature is over the freezing set one and the refrigerating set temperature, when the open air temperature is below the open air set one at step a3;

d3) turning on the compressor and the refrigerating fan, first, if the freezing temperature is over the freezing reference one and the refrigerating temperature is over the refrigerating reference temperature at step c3; and e3) turning on the compressor and the freezing and refrigerating fans to cool the refrigerating and freezing compartments, if the freezing temperature is below the freezing reference one and the refrigerating temperature is below the refrigerating reference temperature at step c3.

78. The control method as claimed in claim 77, in which the routine b3 comprises steps of:

comparing the freezing temperature with the freezing set one appropriate for storing foodstuffs in the freezing compartment at step 331;

comparing the refrigerating temperature with the refrigerating set one at step 332, if the freezing temperature is over the freezing set one at step 331;

turning on the compressor and the refrigerating fan and turning off the freezing fan at step 333, if the refrigerating temperature is over the refrigerating set one at step 332;

turning on the compressor and the freezing fan and turning off the refrigerating fan at step 334, if the refrigerating temperature is below the refrigerating set one at step 332;

comparing the freezing temperature with a second freezing set one which is higher than the freezing temperature by the predetermined temperature at step 335 after performing step 333;

performing step 332 to compare the refrigerating temperature with the refrigerating set one if the freezing temperature is below the second freezing set one at step 335;

turning on the compressor and the freezing and refrigerating fans at step 336, if the freezing temperature is over the second freezing set one at step 335;

comparing the refrigerating temperature with the refrigerating set one at step 337 after performing step 336; and performing step 334, if the refrigerating temperature is below the refrigerating set one at step 337.

79. The control method as claimed in claim 78, furthermore comprising steps of:

comparing the refrigerating temperature with the refrigerating set one at step 337 after performing step 336;

comparing the freezing temperature with the freezing set one at step 338, if the refrigerating temperature is over the refrigerating set one at step 337;

performing step 336, if the freezing temperature is over the freezing set one at step 338; and turning off the compressor and the freezing and refrigerating fans at step 339, if the freezing temperature is below the freezing set one at step 338.

80. The control method as claimed in claim 78, furthermore comprising steps of:

comparing the freezing temperature with the freezing set one at step 340 after performing step 334;

comparing the refrigerating temperature with the refrigerating set one at step 341, if the freezing temperature is over the freezing set one at step 340;

performing step 334, again, if the freezing temperature is below the freezing set one at step 341; and performing step 336, again, if the refrigerating temperature is over the refrigerating set one at step 341.

81. The control method as claimed in claim 78, furthermore comprising steps of:

turning off the compressor and the freezing and refrigerating fans at step 339, if the freezing temperature is below the freezing set one at steps 338 and 340.

82. The control method as claimed in claim 77, in which the routine d3 comprises steps:

comparing the freezing temperature with the freezing set one at step 291;

comparing the refrigerating temperature with a second refrigerating set one which is higher that the refrigerating set temperature, at step 292, if the freezing temperature is over the freezing set one;

turning on the compressor and the refrigerating fan and turning off the freezing fan at step 293, if the refrigerating temperature is over the second refrigerating set one;

turning on the compressor and the freezing and refrigerating fans at step 294, if the refrigerating temperature is below the second refrigerating set one at step 292;

comparing the refrigerating temperature with the refrigerating set one at step 295 after performing step 294;

comparing the freezing temperature with the freezing set one at step 296, if the refrigerating temperature is over the refrigerating set one at step 295; and turning on the compressor and the freezing fan and turning off the refrigerating fan at step 297, if the refrigerating temperature is below the refrigerating set one at step 295.

83. The control method as claimed in claim 82, in which:

the second refrigerating temperature is higher that the refrigerating set one by 1° C. to 5° C.

84. The control method as claimed in claim 82, furthermore comprising steps of:

turning on the compressor and the freezing and refrigerating fans at step 294, if the freezing temperature is over the freezing set one at step 296; and turning off the compressor and the freezing and refrigerating fans at step 298, if the freezing temperature is below the freezing set one at step 296.

85. The control method as claimed in claim 82, furthermore comprising steps of:

comparing the freezing temperature with the freezing set one at step 299 during performing step 297;

comparing the refrigerating temperature with the refrigerating set one at step 295, if the freezing temperature is over the freezing set one at step 299; and turning off the compressor and the freezing and refrigerating fans at step 298, if the freezing temperature is below the freezing set one at step 299.

86. The control method as claimed in claim 82, furthermore comprising steps of:

turning off the compressor and the freezing and refrigerating fans at step 298, if the freezing temperature is below the freezing set one at step 291.

87. The control method as claimed in claim 82, furthermore comprising steps of:

comparing the first surface temperature with 0° C. at step 300 after performing step 298; and turning off the compressor and the freezing fan and turning on the refrigerating fan at step 301, thereby performing the defrosting of the first evaporator, if the first surface temperature is below 0° C.

88. The control method as claimed in claim 82, in which:

the freezing set temperature is −15° C. to −21° C., and the refrigerating temperature is −1° C. to 6° C.

89. The control method as claimed in claim 77, in which the routine e3 furthermore comprises steps of:

comparing the freezing temperature with the freezing set one and the refrigerating temperature with the refrigerating set one, respectively, at steps 231 and 232;

comparing the freezing temperature with the surface second temperature at step 233 in order to delay the operating of the freezing fan for a predetermined time period, if the refrigerating and freezing temperatures are over their set ones at steps 231 and 232;

turning on the compressor and the refrigerating and freezing fans at step 234, if the freezing temperature is over the second surface one at step 233;

turning on the compressor and the refrigerating fan at step 235, if the freezing temperature is below the second surface one at step 233;

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and the freezing fan and turning off the refrigerating fan at step 237, if the freezing temperature is over the second surface one at step 236; and turning on the compressor and turning off the refrigerating and freezing fans at step 238, if the freezing temperature is below the second surface one at step 236.

90. The control method as claimed in claim 89, furthermore comprising steps of:

comparing the freezing temperature with the freezing set one at step 241 after performing steps 234 and 235;

performing step 233 to compare the freezing temperature with the surface second temperature, if the freezing temperature is over the freezing set one at step 241;

comparing the refrigerating temperature with the refrigerating set one at step 242, if the freezing temperature is below the freezing set one;

performing step 235 if the refrigerating temperature is below the refrigerating set one at step 242; and turning off the compressor and the freezing and refrigerating fans at step 240, if the refrigerating temperature is below the refrigerating set one at step 242.

91. The control method as claimed in claim 89, furthermore comprising steps of:

comparing the second surface temperature with 0° C. at step 243, after performing step 240;

turning off the compressor and the freezing fan and turning on the refrigerating fan at step 244, if the second surface temperature is below 0° C., thereby performing the defrosting of the first evaporator.

92. The control method as claimed in claim 89, furthermore comprising steps of:

comparing the second surface temperature with 0° C. at step 243, after performing step 240;

turning off the compressor and the freezing fan and turning on the refrigerating fan at step 244, thereby performing the defrosting of the first evaporator, if the second surface temperature is below 0° C.

93. The control method as claimed in claim 89, in which:

the second refrigerating set temperature is higher than the refrigerating set one by 1° C. to 5° C.

94. The control method as claimed in claim 89, furthermore comprising steps of:

determining whether the freezing temperature is higher than the second surface refrigerating one by 1° C. to 5° C.

95. The control method as claimed in claim 89, in which:

the open air reference temperature is 30° C. to 35° C.

96. The control method as claimed in claim 89, in which:

the freezing set temperature is −15° C. to −21° C., and the refrigerating temperature is −1° C. to 6° C.

97. The control method as claimed in claim 79, furthermore comprising steps of:

comparing the freezing temperature with the second surface one at step 236 in order to delay the operating of the freezing fan for a predetermined time period, if the freezing temperature is over the freezing set one, but the refrigerating temperature is over the refrigerating set one at said steps 231 and 232;

turning on the compressor and turning off the refrigerating and freezing fans at step 238, if the freezing temperature is below the second surface one at step 236; and turning on the compressor and the freezing fan and turning off the refrigerating fan at step 237, if the freezing temperature is over the second surface one at step 236.

* * * * *